US007048808B2

(12) United States Patent
Kaneko et al.

(10) Patent No.: US 7,048,808 B2
(45) Date of Patent: May 23, 2006

(54) RARE-EARTH SINTERED MAGNET AND METHOD OF PRODUCING THE SAME

(75) Inventors: Yuji Kaneko, Uji (JP); Katsuya Taniguchi, Sanda (JP); Takao Sekino, Mishima-gun (JP)

(73) Assignee: Neomax Co., Ltd., Osaka (JP)

( * ) Notice: Subject to any disclaimer, the term of this patent is extended or adjusted under 35 U.S.C. 154(b) by 505 days.

(21) Appl. No.: 09/966,743

(22) Filed: Oct. 1, 2001

(65) Prior Publication Data

US 2002/0062884 A1 May 30, 2002

(30) Foreign Application Priority Data

Oct. 4, 2000 (JP) ..... 2000-305121
Oct. 12, 2000 (JP) ..... 2000-312540

(51) Int. Cl.
*H01F 1/057* (2006.01)

(52) U.S. Cl. ..... 148/302; 148/101; 75/232; 75/244; 75/246; 419/12; 419/45; 419/46

(58) Field of Classification Search ..... 148/302, 148/101, 102, 104; 75/232, 244, 246; 419/12, 419/45, 46

See application file for complete search history.

(56) References Cited

U.S. PATENT DOCUMENTS 5,431,747 A * 7/1995 Takebuchi et al. ..... 148/302
5,447,578 A * 9/1995 Ozaki et al. ..... 148/302
5,589,009 A 12/1996 Kim et al.
5,595,608 A * 1/1997 Takebuchi et al. ..... 148/104
5,963,774 A * 10/1999 Sasaki et al. ..... 419/33

FOREIGN PATENT DOCUMENTS

EP 0 255 939 A2 2/1988
JP 63-6808 * 1/1988 ..... 148/302
JP 3-20001 * 1/1991 ..... 148/302
JP 04-155902 5/1992
JP 07-011306 1/1995
JP 08-107034 4/1996

OTHER PUBLICATIONS

Notice of Reasons for Rejection (Dated Apr. 8, 2003) w/Translation.

M.G. Benz et al., "High–Energy–Product (Pr–Nd–Ce) FeB Magnets Produced DIrectly from Mixed–Rare–Earth–Oxide Feed for MRI Medical Imaging Applications", pp. 1–11 (plus Technical Report Abstract Page), Jun. 2000, GE Research & Development Center, 2000CRD061, Class 1.

(Continued)

*Primary Examiner*—John Sheehan
(74) *Attorney, Agent, or Firm*—Nixon Peabody LLP; Jeffrey L. Costellia

(57) ABSTRACT

The present invention provides a rare-earth sintered magnet exhibiting desirable magnetic properties in which the amount of Nd and/or Pr forming a non-magnetic phase in a grain boundary phase is reduced. Specifically, the present invention provides a rare-earth sintered magnet having a composition of $(R1_x+R2_y)T_{100-x-y-z}Q_z$ where R1 is at least one element selected from the group consisting of all rare-earth elements excluding La (lanthanum), Y (yttrium) and Sc (scandium); R2 is at least one element selected from the group consisting of La, Y and Sc; T is at least one element selected from the group consisting of all transition elements; Q is at least one element selected from the group consisting of B and C, and including, as a main phase, a crystal grain of an $Nd_2Fe_{14}B$ crystalline structure, wherein: molar fractions x, y and z satisfy $8 \leqq x \leqq 18$ at %, $0.1 \leqq y \leqq 3.5$ at % and $3 \leqq z \leqq 20$ at %, respectively; and a concentration of R2 is higher in at least a part of a grain boundary phase than in the main phase crystal grains.

19 Claims, 13 Drawing Sheets

OTHER PUBLICATIONS

M.G. Benz et al., "Rare–Earth Magnets and Their Applications", pp. 99–108, 2000, Proceedings of the 16th International Workshop on Rare–Earth Magnets and Their Applications, vol. 1.

The Condensed Chemical Dictionary, $8^{th}$ edition, 1971, p. 753.*

Honshima et al., "*High–Energy NdFeB Magnets and Their Applications*", Journal of Materials Engineering and Performance vol. 3(2), Apr. 3, 1994, pp. 218–222.

European Search Report Dated Aug. 28, 2003.

* cited by examiner

SINTERING
COOLING
PRIMARY PHASE
GRAIN BOUNDARY PHASE
Co
Nd
Y
Y-O
$Nd_3Co$

RARE-EARTH SINTERED MAGNET AND METHOD OF PRODUCING THE SAME

BACKGROUND OF THE INVENTION

1. Field of the Invention

The present invention relates to an R—Fe—B rare-earth magnet and a method of producing the same.

2. Description of Related Art

In the prior art, neodymium (Nd) and/or praseodymium (Pr) have primarily been used as the rare-earth element R of an R—Fe—B rare-earth magnet because the use of these rare-earth elements provides particularly desirable magnetic properties.

In recent years, the variety of applications of R—Fe—B magnets has expanded, and the Nd and Pr consumption is increasing rapidly. Accordingly, there is a strong demand to improve the efficiency of use of Nd and Pr, which are precious natural resources, and for reducing the material cost of an R—Fe—B magnet.

The simplest way to reduce the Nd and Pr consumption is to substitute Nd and Pr with another rare-earth element that functions similarly to Nd and Pr. It is known in the art, however, that the magnetic properties, such as magnetization, deteriorate when a rare-earth element other than Nd and Pr is added to an R—Fe—B rare-earth magnet. Therefore, rare-earth elements other than Nd and Pr have rarely been used in R—Fe—B rare-earth magnets.

For example, when an R—Fe—B alloy is made by melting and solidifying a material alloy with Yttrium (Y), a rare-earth element, being added to the material along with Nd, Y is taken into the main phase of the alloy. The main phase of an R—Fe—B alloy principally has a tetragonal $R_2Fe_{14}B$ type crystalline structure. It is known in the art that the highest magnetization is exhibited when R is Nd and/or Pr (and dysprosium (Dy), terbium (Tb), etc., substituting part of Nd and/or Pr). When R in the $R_2Fe_{14}B$ crystalline structure forming the main phase is substituted either partially or entirely with a rare-earth element such as Y, the magnetization substantially decreases.

An R—Fe—B magnet with cerium (Ce), a rare-earth element like Nd and Pr, added thereto is disclosed in the report of Proc. 16th Inter. Workshop on Rare Earth Magnets and their Applications, 2000. P99. According to the report, the residual magnetic flux density or remanence $B_r$ decreases linearly due to the addition of Ce.

In view of the above, it is believed that the addition of any magnetization-decreasing rare-earth element R, other than Nd, Pr, Dy, and Tb, should be avoided as much as possible.

Nd and/or Pr not only form a main phase but also exist in a grain boundary phase, and play an important roll of forming a liquid phase in a sintering process. However, Nd and/or Pr existing in a grain boundary phase form a non-magnetic phase and do not contribute to the improvement of magnetization. In other words, a part of Nd and/or Pr is always consumed for the formation of a non-magnetic phase, failing to directly contribute to the magnetic properties.

In order to efficiently use Nd and/or Pr so as to effectively achieve desirable magnetic properties, it is preferred that most of Nd and/or Pr is taken into the $R_2Fe_{14}B$ crystal phase. However, techniques for realizing this did not exist in the prior art.

In the prior art, a part of Fe in the main phase having a tetragonal $R_2Fe_{14}B$ crystalline structure is substituted with cobalt (Co) by adding Co to a material alloy in order to improve the heat resistance of an R—Fe—B rare-earth magnet. When a part of Fe is substituted with Co, the Curie temperature of the main phase increases, whereby desirable magnetic properties can be exhibited even at higher temperatures.

In recent years, in some fields of art such as motors for use in automobiles, there is a demand for a magnet having a higher performance and hence a demand for the use of an R—Fe—B rare-earth magnet having a higher performance than that of a ferrite magnet. However, the heat resistance of an R—Fe—B rare-earth magnet is not sufficient for use under a high temperature environment such as those experienced by a motor in an automobile. Accordingly, there is a strong demand for further improving the heat resistance of R—Fe—B rare-earth magnets.

It is believed that in order to further improve the heat resistance of an R—Fe—B rare-earth magnet, it is preferable to add more Co. However, Co added to a material alloy not only substitutes Fe in the main phase of a sintered magnet but also exists in a grain boundary phase to form an $NdCo_2$ compound and/or a $PrCO_2$ compound therein. Thus, a part of Co added is not used for substituting Fe but is wasted in the grain boundary phase. Another problem is that the above compounds are a ferromagnetic substance and thus decreases the coercive force of the sintered magnet. Therefore, simply increasing the amount of Co to be added is not an effective way to substitute Fe in the main phase, and doing do can substantially decrease the coercive force of an R—Fe—B rare-earth magnet.

SUMMARY OF THE INVENTION

It is therefore an object of this invention to provide a rare-earth sintered magnet exhibiting desirable magnetic properties in which the amount of Nd and/or Pr forming a non-magnetic phase in a grain boundary phase is reduced, and a method of producing the same.

Another object of the present invention is to provide a rare-earth sintered magnet in which added Co is efficiently taken into the main phase, thereby exhibiting desirable magnetic properties, and a method of producing the same.

A rare-earth sintered magnet of this invention has a composition of $(R1_x+R2_y)T_{100-x-y-z}Q_z$ (R1 is at least one element selected from the group consisting of all rare-earth elements excluding La (lanthanum), Y (yttrium) and Sc (scandium); R2 is at least one element selected from the group consisting of La, Y and Sc; T is at least one element selected from the group consisting of all transition elements; and Q is at least one element selected from the group consisting of B and C), and includes, as a main phase, a crystal grain of an $Nd_2Fe_{14}B$ crystalline structure, wherein: molar fractions x, y and z satisfy $8 \leqq x \leqq 18$ at %, $0.1 \leqq y \leqq 3.5$ at % and $3 \leqq z \leqq 20$ at %, respectively; and a concentration of R2 is higher in at least a part of a grain boundary phase than in the crystal grain.

In a preferred embodiment, the molar fractions x and y satisfy $0.01 \leqq y/(x+y) \leqq 0.23$.

In a preferred embodiment, R2 includes at least Y (yttrium).

In a preferred embodiment, an amount of oxygen is in a range of 2000 ppm by weight to 8000 ppm by weight.

A method of producing a rare-earth sintered magnet, according to the invention, includes the steps of: preparing a powder of a rare-earth alloy having a composition of $(R1_x+R2_y)T_{100-x-y-z}Q_z$ (R1 is at least one element selected from the group consisting of all rare-earth elements excluding La, Y and Sc; R2 is at least one element selected from the group consisting of La, Y and Sc; T is at least one element selected from the group consisting of all transition elements; and Q is at least one element selected from the group consisting of B and C), wherein molar fractions x, y and z satisfy $8 \leqq x \leqq 18$ at %, $0.1 \leqq y \leqq 3.5$ at % and $3 \leqq z \leqq 20$ at %, respectively; and sintering the rare-earth alloy powder, wherein R2 existing in a main phase crystal grain of an $Nd_2Fe_{14}B$ crystalline structure in the rare-earth alloy before sintering is diffused into a grain boundary phase in the sintering step, whereby a concentration of R2 is higher in at least a part of the grain boundary phase than in the crystal grain.

In a preferred embodiment, an amount of oxygen included in the rare-earth alloy powder is in a range of 2000 ppm by weight to 8000 ppm by weight.

In a preferred embodiment, R1 existing in the grain boundary phase in the rare-earth alloy before sintering is diffused into the main phase crystal grain in the sintering step.

In a preferred embodiment, an oxide of R2 is formed in the grain boundary phase in the sintering step.

In a preferred embodiment, the sintering step includes a first step of maintaining the rare-earth alloy powder at a temperature in a range of 650 to 1000° C. for 10 to 240 minutes, and a second step of further sintering the rare-earth alloy powder at a temperature higher than that used in the first step.

In a preferred embodiment, the rare-earth alloy powder is obtained through pulverization in a gas whose oxygen concentration is controlled.

In a preferred embodiment, the rare-earth alloy powder is obtained through pulverization in a gas whose oxygen concentration is controlled to be 20000 ppm or less by volume.

In a preferred embodiment, an average particle diameter (FSSS particle size) of the rare-earth alloy powder is 5 μm or less.

Another inventive rare-earth sintered magnet has a composition of $(R1_x+R2_y)(T1_p+T2_q)_{100-x-y-z-r}Q_zM_r$ (R1 is at least one element selected from the group consisting of all rare-earth elements excluding La (lanthanum), Y (yttrium) and Sc (scandium); R2 is at least one element selected from the group consisting of La, Y and Sc; T1 is Fe; T2 is at least one element selected from the group consisting of all transition elements excluding Fe; Q is at least one element selected from the group consisting of B and C; and M is at least one element selected from the group consisting of Al, Ga, Sn and In), and includes, as a main phase, a crystal grain of an $Nd_2Fe_{14}B$ crystalline structure, wherein: molar fractions x, y, z, p, q and r satisfy $8 \leqq x+y \leqq 18$ at %, $0<y \leqq 4$ at %, $3 \leqq z \leqq 20$ at %, $0<q \leqq 20$ at %, $0<q/(p+q) \leqq 0.3$ at % and $0 \leqq r \leqq 3$ at %, respectively; and a concentration of R2 is higher in at least a part of a grain boundary phase than in the crystal grain.

In a preferred embodiment, the molar fraction y satisfies $0.5<y \leqq 3$ at %.

In a preferred embodiment, R2 includes at least Y (yttrium).

In a preferred embodiment, T2 includes at least Co (cobalt).

In a preferred embodiment, an amount of oxygen is in a range of 2000 ppm by weight to 8000 ppm by weight.

Another inventive method of producing a rare-earth sintered magnet includes the steps of: preparing a powder of a rare-earth alloy having a composition of $(R1_x+R2_y)(T1_p+T2_q)_{100-x-y-z-r}Q_zM_r$ (R1 is at least one element selected from the group consisting of all rare-earth elements excluding La (lanthanum), Y (yttrium) and Sc (scandium); R2 is at least one element selected from the group consisting of La, Y and Sc; T1 is Fe; T2 is at least one element selected from the group consisting of all transition elements excluding Fe; Q is at least one element selected from the group consisting of B and C; and M is at least one element selected from the group consisting of Al, Ga, Sn and In), and including, as a main phase, a crystal grain of an $Nd_2Fe_{14}B$ crystalline structure, wherein: molar fractions x, y, z, p, q and r satisfy $8 \leqq x+y \leqq 18$ at %, $0<y \leqq 4$ at %, $3 \leqq z \leqq 20$ at %, $0<q \leqq 20$ at %, $0<q/(p+q) \leqq 0.3$ at % and $0 \leqq r \leqq 3$ at %, respectively; and sintering the rare-earth alloy powder, wherein R2 existing in the main phase crystal grain of the $Nd_2Fe_{14}B$ crystalline structure in the rare-earth alloy before sintering is diffused into a grain boundary phase in the sintering step, whereby a concentration of R2 is higher in at least a part of the grain boundary phase than in the crystal grain.

In a preferred embodiment, an amount of oxygen included in the rare-earth alloy powder is in a range of 2000 ppm by weight to 8000 ppm by weight.

In a preferred embodiment, R1 existing in the grain boundary phase in the rare-earth alloy before sintering is diffused into the main phase crystal grain in the sintering step.

In a preferred embodiment, an oxide of R2 is formed in the grain boundary phase in the sintering step.

In a preferred embodiment, the sintering step includes a first step of maintaining the rare-earth alloy powder at a temperature in a range of 650 to 1000° C. for 10 to 240 minutes, and a second step of further sintering the rare-earth alloy powder at a temperature higher than that used in the first step.

In a preferred embodiment, the rare-earth alloy powder is obtained through pulverization in a gas whose oxygen concentration is controlled.

In a preferred embodiment, the rare-earth alloy powder is obtained through pulverization in a gas whose oxygen concentration is controlled to be 20000 ppm or less by volume.

In a preferred embodiment, an average particle diameter (FSSS particle size) of the rare-earth alloy powder is 5 μm or less.

BRIEF DESCRIPTION OF THE DRAWINGS

FIG. 1A to FIG. 1C are schematic diagrams of main phase crystal grains and a grain boundary phase, wherein FIG. 1A illustrates the microstructure of a material alloy, FIG. 1B illustrates the microstructure during a sintering process, and FIG. 1C illustrates the microstructure of a sintered magnet;

FIG. 7A to FIG. 7D are schematic diagrams of main phase crystal grains and a grain boundary phase, wherein FIG. 7A illustrates the microstructure of a material alloy, FIG. 7B and FIG. 7C each illustrate the microstructure during a sintering process, and FIG. 7D illustrates the microstructure of a sintered magnet;

DETAILED DESCRIPTION OF THE INVENTION

In a first embodiment of the present invention, Y, La and/or Sc are added, in addition to Nd, and these elements are concentrated in a grain boundary phase, so that an amount of Nd that would otherwise be consumed for the formation of a non-magnetic phase in the grain boundary phase is diffused from the grain boundary phase into the main phase crystal grains. In this way, Nd is efficiently used as a constituent element of the main phase ($Nd_2Fe_{14}B$ phase) providing hard magnetism. The term "$Nd_2Fe_{14}B$ phase" as used herein includes a phase in which a part of Nd is substituted with Pr, Dy and/or Tb.

In a rare-earth magnet of the present invention, a large amount of Nd exists in the $Nd_2Fe_{14}B$ phase, which is the main phase, while Y, La and/or Sc play the roll of Nd in the grain boundary phase. Thus, it is possible to reduce the amount of Nd (Pr) to be used with substantially no decrease in the magnetization.

According to an experiment conducted by the present inventors, Y exists primarily in the main phase, thereby decreasing the magnetization, in the stage of a material alloy such as an ingot cast alloy or a strip cast alloy. The experiment also reveals that the concentration of Y in the main phase of an ingot cast alloy is higher than that of a strip cast alloy, since a cooling rate by an ingot casting method (less than $10^{2\circ}$ C./sec) is lower than that by a strip casting method ($10^{2\circ}$ C./sec or more). A feature of the present invention lies in that Y in the main phase is concentrated in the grain boundary phase through a sintering process after making a powder of such a material alloy.

Initially, the feature of the present invention will be described with reference to FIG. 1A to FIG. 1C.

Figure 1A:
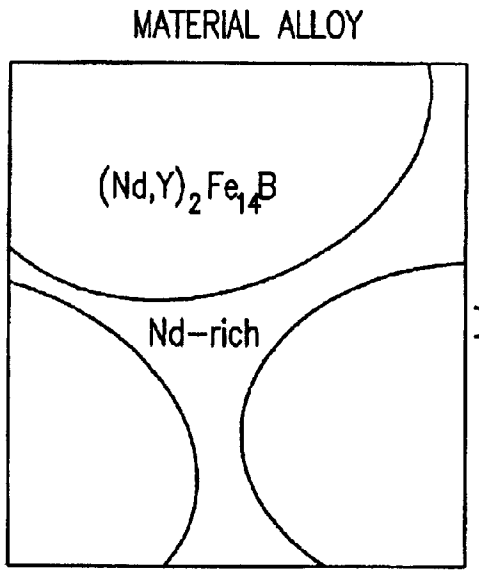
Figure 1B:
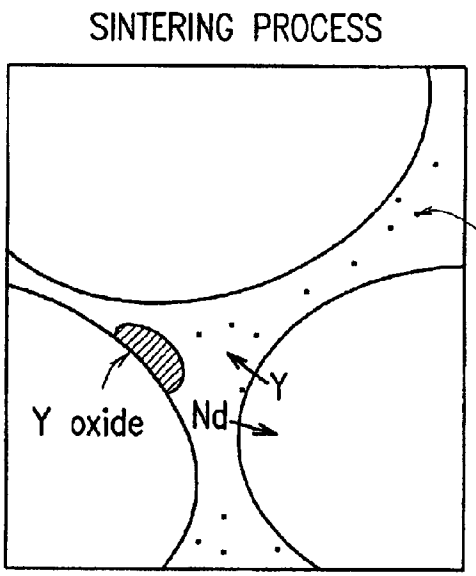
Figure 1C:
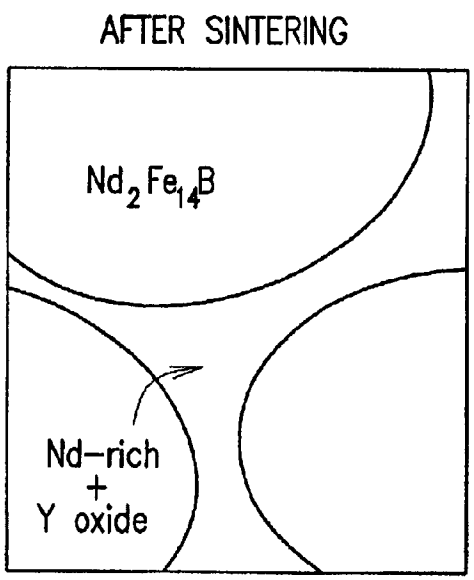

FIG. 1A to FIG. 1C are schematic diagrams of main phase crystal grains and a grain boundary phase, illustrating how Nd and Y are diffused and distributed through a sintering process from the material alloy stage.

First, as illustrated in FIG. 1A, in the mother alloy stage, Y and Nd are both taken in the crystal grains of $Nd_2Fe_{14}B$, and Y and Nd exist at the site of rare earth element of Nd2Fe14B.

When the mother alloy is made by an ingot casting method, the Y concentration in the grain boundary phase is lower than that in the crystal grains, and an Nd-rich phase is formed in the grain boundary phase. When the mother alloy is made by a strip casting method, R2 such as Y exists also in the grain boundary, but this is due to a non-equilibrium state. R2 existing in the grain boundary also has the same effect in subsequent steps as that of R2 existing in the main phase.

According to the present invention, Y is diffused from the inside of the crystal grains (main phase) into the grain boundary phase through the sintering process. During the sintering process, an oxide of Y is formed in the grain boundary phase, as illustrated in FIG. 1B. At this time, Nd is diffused in the opposite direction. As a result, the Y concentration in the grain boundary phase increases to be greater than that in the crystal grains. As a result, the amount of Y contained in the main phase decreases, as illustrated in FIG. 1C, thereby increasing the magnetization.

It is believed that in order to realize the mutual diffusion of Y and Nd as described above, an appropriate amount of oxygen needs to be present in the grain boundary phase during the sintering process. This is because the present invention causes the diffusion as described above utilizing the fact that Y more stably combines with oxygen to form an oxide than Nd. For such an introduction of oxygen into the grain boundary phase, it is preferred to slightly oxidize the powder particle surface in the pulverization step, for example.

The first embodiment of the present invention will now be described in greater detail.

Material Alloy

First, a rare-earth alloy having a composition of $(R1_x+R2_y)T_{100-x-y-z}Q_z$ is prepared. In the composition, R1 is at least one element selected from the group consisting of all rare-earth elements excluding Y (yttrium), La (lanthanum) and Sc (scandium); R2 is at least one element selected from the group consisting of La, Y and Sc; T is at least one element selected from the group consisting of all transition elements; Q is at least one element selected from the group consisting of B and C; and the molar fractions x, y and z satisfy $8 \leqq x \leqq 18$ at %, $0.1 \leqq y \leqq 3.5$ at % and $3 \leqq z \leqq 20$ at %, respectively.

For example, an ingot casting method or a quenching method (a strip casting method or a centrifugal casting method) may be used for making such an alloy. As an example, a method of making a material alloy by using a strip casting method will now be described.

First, an alloy having a composition as shown above is melted in a high frequency melting process in an argon atmosphere to obtain a molten alloy. After maintaining the molten alloy at 1350° C., the molten alloy is rapidly cooled by a single chill roll method so as to obtain a solidified alloy in the form of flakes having a thickness of about 0.3 mm, for example. The cooling conditions include, for example, a roll circumferential speed of about 1 m/sec, a cooling rate of 500° C./sec and a sub-cooling degree of 2000° C. The rapidly cooled alloy thus obtained is pulverized into flakes having a size of 1 to 10 mm before the hydrogen pulverization process. A method of producing a raw material alloy by a strip casting method is disclosed in, for example, U.S. Pat. No. 5,383,978, the disclosure of which is hereby incorporated by reference.

As noted above, Y exists in the $Nd_2Fe_{14}B$ main phase in such a material alloy stage.

First Pulverization Step

Figure 2:
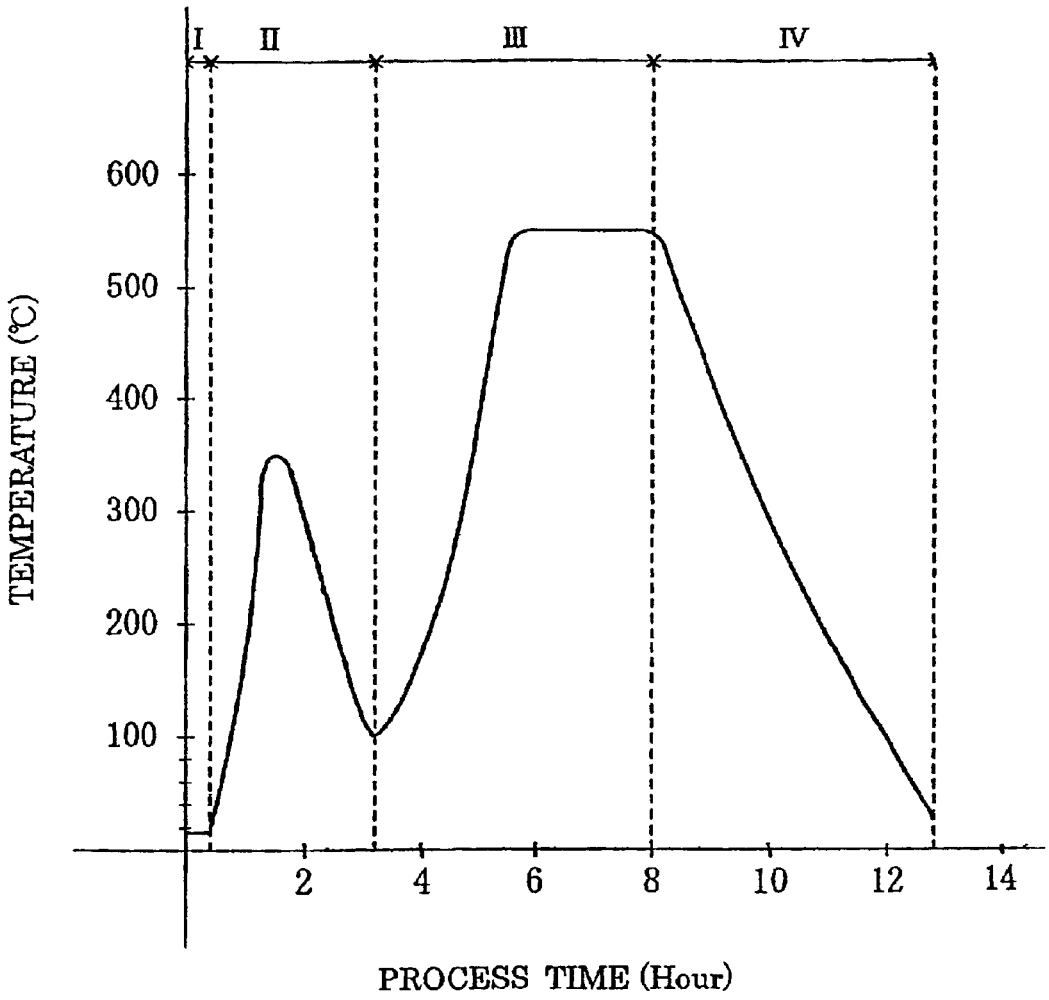
FIG. 2 is a graph illustrating an example of a temperature profile in a hydrogen pulverization process that may suitably be used in the present invention.

The material alloy that has been coarsely pulverized into flakes is filled into a plurality of raw material packs (made of stainless steel, for example) and mounted on a rack. Then, the rack with the raw material packs mounted thereon is inserted into a hydrogen furnace. Then, the hydrogen furnace is closed and a hydrogen embrittlement process (hereinafter referred to also as "a hydrogen pulverization process") is started. The hydrogen pulverization process is performed in accordance with a temperature profile illustrated in FIG. 2, for example. In the example of FIG. 2, an evacuation process I is performed for 0.5 hour, after which a hydrogen occlusion process II is performed for 2.5 hours. In the hydrogen occlusion process II, a hydrogen gas is supplied into the furnace so as to turn the inside of the furnace into a hydrogen atmosphere. At this time, the hydrogen pressure is preferably about 200 to about 400 kPa.

Then, a dehydrogenation process III is performed for 5.0 hours under a depressurized atmosphere of about 0 to about 3 Pa, after which a material alloy cooling process IV is performed for 5.0 hours while supplying an argon gas into the furnace.

In the cooling process IV, while the atmosphere temperature in the furnace is relatively high (e.g., greater than 100° C.), the material alloy is cooled by supplying an inert gas at normal temperature into the hydrogen furnace. Then, after the material alloy temperature has decreased to a relatively low level (e.g., 100° C. or less), an inert gas that has been cooled below normal temperature (e.g., about 10° C. lower than room temperature) is supplied into the hydrogen furnace. It is preferred, in terms of the cooling efficiency, to cool the material alloy in this way. The amount of the argon gas to be supplied may be set to about 10 to about 100 $Nm^3$/min.

It is preferred that after the temperature of the material alloy has decreased to be about 20 to about 250° C., an inert gas of a generally normal temperature (a temperature that is lower than room temperature by 50° C. or less) is supplied into the hydrogen furnace, allowing the temperature of the material alloy to reach a normal temperature level. In this way, it is possible to avoid dew condensation in the furnace occurring when the hydrogen furnace is opened. When moisture is present in the furnace due to dew condensation, the moisture is frozen/vaporized in the evacuation process, thereby making it difficult to increase the degree of vacuum and increasing the period of time required for the evacuation process I.

It is preferred that the coarsely-pulverized alloy powder obtained through the hydrogen pulverization process is taken out of the hydrogen furnace under an inert atmosphere so that the coarsely pulverized powder does not contact the atmospheric air. In this way, the coarsely pulverized powder is prevented from being oxidized and generating heat, and the magnetic properties of the magnet are improved. Then, the coarsely-pulverized material alloy is filled into a plurality of raw material packs and mounted on a rack.

Through the hydrogen pulverization process, the rare-earth alloy is pulverized to a size of about 0.1 to several millimeters, with the average particle diameter being 500 μm or less. It is preferred that after the hydrogen pulverization process, the embrittled material alloy is cracked into finer powder and cooled by using a cooling device such as a rotary cooler. When the material is taken out at a relatively high temperature, the duration of the cooling process using a rotary cooler, or the like, can be increased accordingly.

Through the hydrogen pulverization process, the material alloy is cracked at R (rare earth metal)-rich portions thereof due to hydrogen occlusion. As a result, a large amount of rare earth metal is exposed on the surface of the coarsely pulverized powder, and the coarsely pulverized powder in this state is very likely to be oxidized.

Second Pulverization Process

Next, the coarsely pulverized powder that has been made in the first pulverization process is finely pulverized by using a jet mill. A cyclone classifier is connected to the jet mill used in the present embodiment.

The jet mill receives a supply of the rare-earth alloy (coarsely pulverized powder) that has been coarsely pulverized in the first pulverization process, and the rare-earth alloy is pulverized in the pulverizer. The powder that has been pulverized in the pulverizer is collected in a collection tank via the cyclone classifier.

The process will now be described in greater detail.

The coarsely pulverized powder is introduced into the pulverizer and is flung up in the pulverizer by a rapid flow of an inert gas injected from an internal nozzle. Thus, the coarsely pulverized powder flies around in the pulverizer along with the rapid gas flow so as to be finely pulverized through collision between powder particles being pulverized.

The finely pulverized powder particles ride an upward gas flow so as to be introduced into a classification rotor. Then, the powder particles are classified by the classification rotor. Coarse powder particles cannot go out of the classification rotor and the coarse powder particle are pulverized again in the pulverizer. Those powder particles that have been pulverized to a particle diameter less than or equal to a pre-determined particle diameter are introduced into the classifier main body of the cyclone classifier. In the classifier main body, relatively large powder particles having a particle diameter equal to or greater than the predetermined particle diameter are deposited into the collection tank provided in the bottom, while super fine powder particles are discharged through a discharge pipe along with the inert gas flow.

In the present embodiment, a slight amount of oxygen (20000 ppm or less by volume; e.g., about 10000 ppm by volume) is mixed with the inert gas introduced into the jet mill. In this way, the surface of the finely pulverized powder is oxidized to an appropriate degree so that rapid oxidization/heat generation does not occur when the finely pulverized powder contacts the air atmosphere.

It is believed that oxidization of the powder particle surface plays an important roll in the diffusion of Y from the main phase into the grain boundary phase in the sintering process. According to a study by the present inventors, it is preferred that the amount of oxygen in the powder is adjusted to be in the range of 2000 to 8000 ppm (by weight).

As described above, the hydrogen pulverization process produces a coarsely pulverized powder whose particle surface is very likely to be oxidized. As a result, a finely pulverized powder made from the hydrogen-treated powder provides a preferable effect upon the Y diffusion from the crystal grain into the grain boundary.

Moreover, in order to diffuse Y from the inside of the particles into the grain boundary phase, it is preferred that the average particle diameter of the powder (FSSS particle size) is 5 μm or less, more preferably, 4 μm or less. When the particle diameter is greater than 5 μm, Y needs to diffuse over an excessive distance, thereby increasing the amount of Y remaining in the crystal grains (main phase), and thus decreasing the magnetization.

The pulverizer is not limited to a jet mill, but may be an attritor or a ball mill.

Press-Compaction

In the present embodiment, a lubricant in an amount of 0.3 wt %, for example, is added and mixed in the magnetic powder obtained as described above in a rocking mixer so as to cover the surface of the alloy powder particles with the lubricant. The lubricant may be a lubricant obtained by diluting a fatty acid ester with a petroleum solvent. In the present embodiment, methyl caproate is used as a fatty acid ester and isoparaffin as a petroleum solvent. The weight ratio between methyl caproate and isoparaffin is, for example, 1:9. Such a liquid lubricant covers the surface of the powder particles, thereby preventing the particles from being oxidized while improving the orientation property during a pressing process and facilitating the removal of the compact following a pressing process (by making the density of the compact uniform so as to prevent the compact from being broken apart or cracked).

The type of lubricant is not limited to the above. Instead of methyl caproate, the fatty acid ester may be, for example, methyl caprylate, methyl laurylate, methyl laurate, or the like. The solvent may be a petroleum solvent such as isoparaffin, a naphthenic solvent, or the like. The lubricant may be added at any timing, i.e., before the fine pulverization by the jet mill, during the fine pulverization or after the fine pulverization. A solid dry lubricant such as zinc stearate may be used instead of, or in addition to, a liquid lubricant.

The magnetic powder obtained as described above is then compacted in an orientation magnetic field by using a known compacting apparatus.

Sintering Process

A step of maintaining the powder compact at a temperature in the range of 650 to 1000° C. for 10 to 24 minutes, and a step of further sintering the powder compact at a higher temperature (e.g., 1000 to 1100° C.), are performed successively. During the sintering process, particularly, during a period in which a liquid phase is produced (while the temperature is in the range of 650 to 1000° C.), Nd starts to be melted, and mutual diffusion occurs between Y, existing primarily in the main phase crystal grains, and Nd, existing in the grain boundary phase. Specifically, Y diffuses from the main phase into the grain boundary phase under a diffusion-driving force that is in proportion to the concentration gradient between the inside of the main phase crystal grains and the grain boundary phase (corresponding to "the difference between the Y concentration in the main phase and that in the liquid phase"), whereas Nd diffuses in the opposite direction, i.e., from the grain boundary phase into the main phase.

Since Y having diffused into the grain boundary phase combines with oxygen existing in the grain boundary phase so as to be turned into an oxide and consumed, the Y concentration gradient to be the diffusion-driving force is maintained. Since Y more stably forms an oxide than Nd, Y diffuses from the main phase into the liquid phase while Nd diffuses from the liquid phase into the main phase.

In order to sufficiently diffuse Y into the grain boundary phase so that a large amount of Nd existing in the grain boundary phase is taken into the main phase, it is preferred that the amount of oxygen in the powder is controlled in the range of 2000 to 8000 ppm (by weight) as described above. When the amount of oxygen is less than 2000 ppm (by weight), Y is not sufficiently diffused into the grain boundary phase, leaving a large amount of Y in the main phase, thereby decreasing the magnetization. When the amount of oxygen is greater than 8000 ppm (by weight), rare-earth elements are consumed by oxide formation, thereby reducing the amount of rare-earth element that contributes to the liquid phase formation. In such a case, the density of the sintered body decreases, or the magnetic properties deteriorate. Preferably a thin oxide layer is formed on the powder particle surface. By sintering the powder in which the amount of oxygen is controlled as above, a sintered magnet whose oxygen concentration is in a range 2000 to 8000 ppm by weight can be produced.

When the amount of residual hydrogen existing in the alloy after the hydrogen pulverization is too high, a sintering process does not proceed appropriately. However, according to this embodiment, the amount of hydrogen in the powder particle can be reduced into a range from 5 to 100 ppm by weight during the heat treatment at a temperature of 650 to 1000° C.

Also in a case where La and/or Sc are added, it is possible to suppress the consumption, in the grain boundary phase, of a rare-earth element, such as Nd or Pr, that is indispensable for the main phase thereby maintaining the magnetization of the main phase at a high level and thus providing a rare-earth sintered magnet that exhibits desirable magnetic properties.

EXAMPLE

A sintered magnet was produced from a material alloy to which Y, La and Ce were added as rare-earth elements along with Nd by using the production method of the present invention as described above. The material alloy was made by an ingot casting method (cooling rate: less than $10^{2}$° C./sec).

Figure 3:
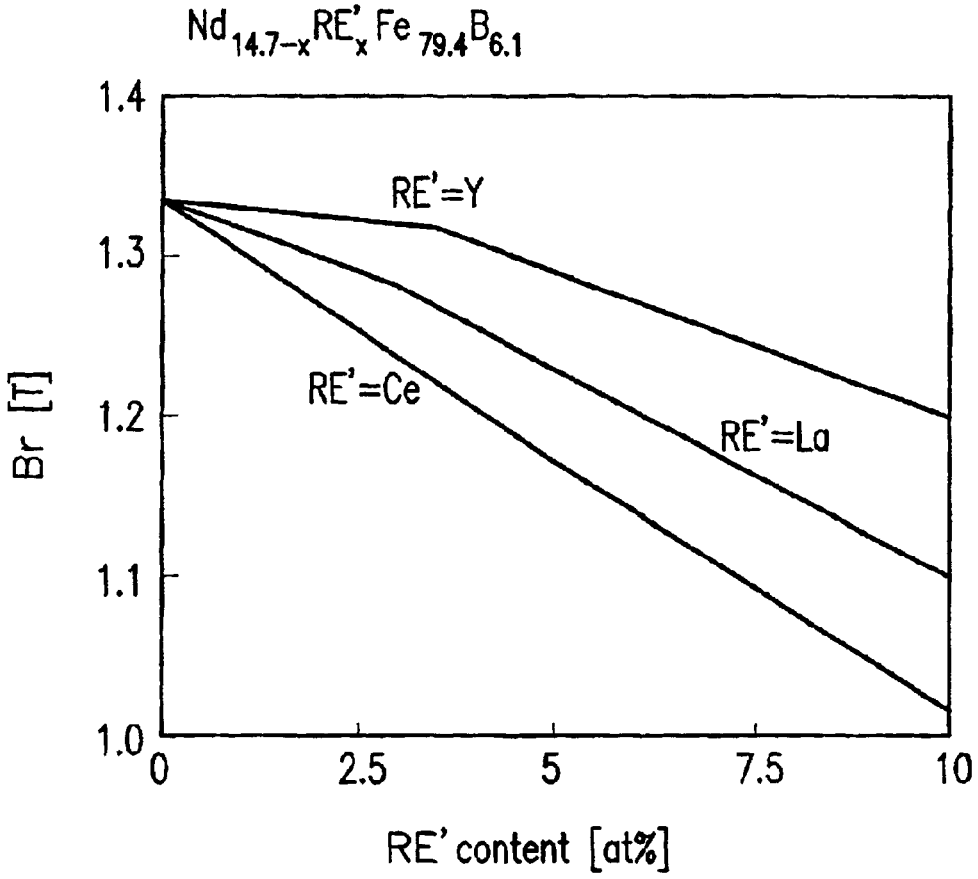
FIG. 3 is a graph illustrating the relationship between the Y, La and Ce contents and the residual magnetic flux density Br for sintered magnets each having a composition of $Nd_{11.8}RE'_{2.4}Fe_{79.7}B_{6.1}$ (where RE' is Y, La or Ce)

FIG. 3 shows the relationship between the Y, La and Ce contents and the residual magnetic flux density or Remanence Br. Each sintered magnet has a composition of $Nd_{11.8}RE'_{2.4}Fe_{79.7}B_{6.1}$, where RE' is Y, La or Ce.

As can be seen from FIG. 3, when Ce is added as RE', $B_r$ decreases linearly as the Ce content increases. In contrast, when Y or La is added as RE', substantially no decrease in $B_r$ is observed in the region where the Y or La content is about 3.5 at % or less. Especially, when Y is added, the decrease in $B_r$ is very small, indicating that Y is more preferable than La as the element to be added.

The following assumption can be made from the graph of FIG. 3. When the RE' content is 3.5 at % or less, Y or La exists in the grain boundary phase and substantially none of the elements Y and La enters the main phase, whereby the magnetization does not decrease. When the RE' content is greater than 3.5 at %, an excess of Y or La cannot diffuse into the grain boundary phase and is thus contained in the main phase, whereby the decrease in magnetization is at a clearly noticeable level. In the case of Ce, the magnetization decreases linearly as the Ce content increases. It is believed that this is because even a slight amount of Ce is taken into the main phase.

Then, the microstructures of Sintered Magnets A to C having the following compositions, respectively, were observed by using an EPMA (electron probe microanalyzer).

| | |
|---|---|
| Sintered Magnet A: | $Nd_{11.8}Y_{2.4}Fe_{79.7}B_{6.1}$ |
| Sintered Magnet B: | $Nd_{11.8}La_{2.4}Fe_{79.7}B_{6.1}$ |
| Sintered Magnet C: | $Nd_{11.8}Ce_{2.4}Fe_{79.7}B_{6.1}$ |

Figure 4A:
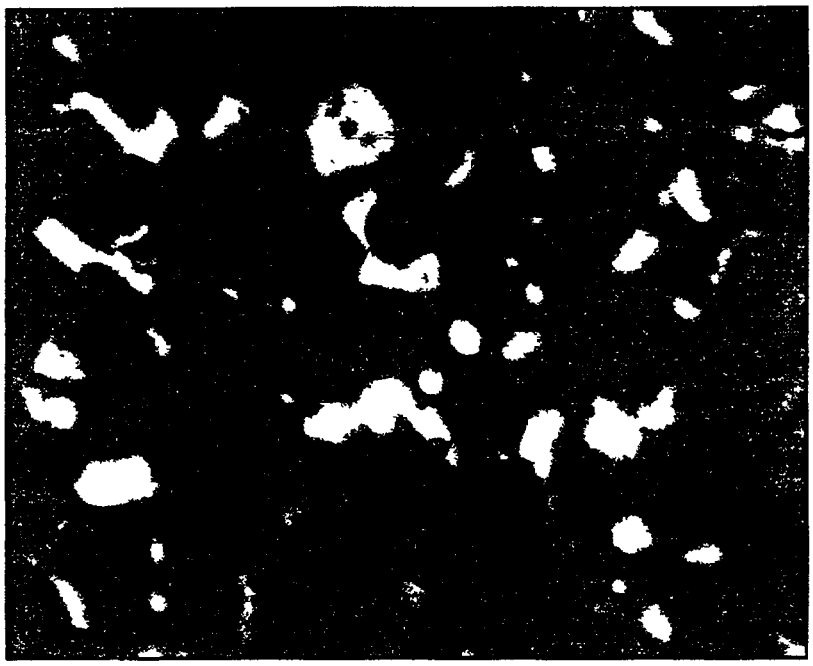
FIG. 4A is a backscattering electron image of Sintered Magnet A ($Nd_{11.8}Y_{2.4}Fe_{79.7}B_{6.1}$)
Figure 4B:
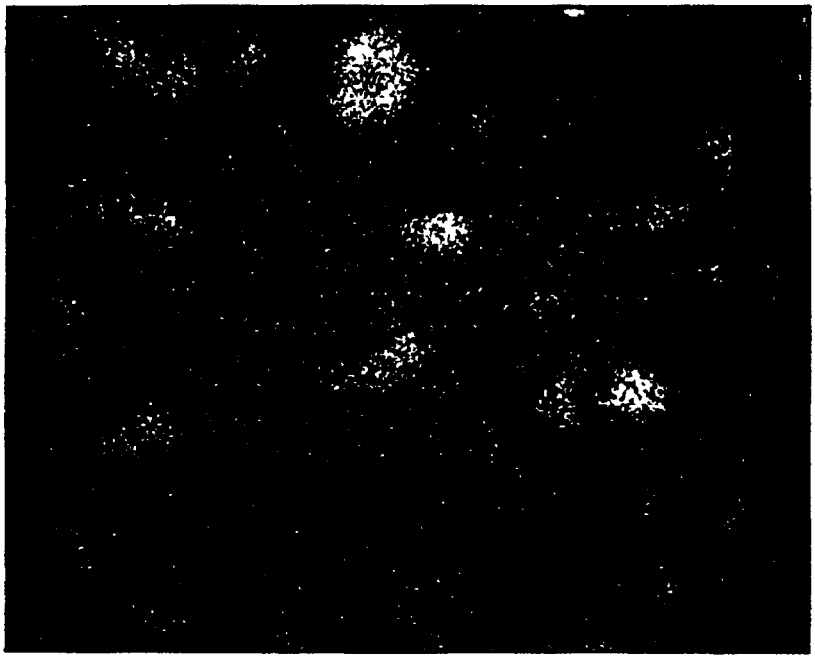
FIG. 4B is a Y mapping image of Sintered Magnet A.
Figure 4C:
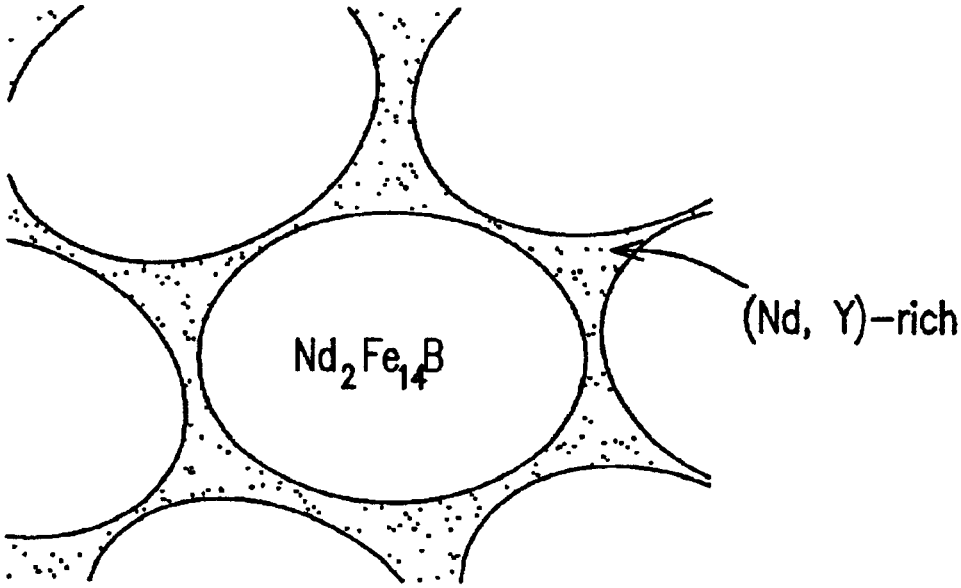
FIG. 4C is a schematic diagram illustrating the microstructure of Sintered Magnet A.
Figure 5A:
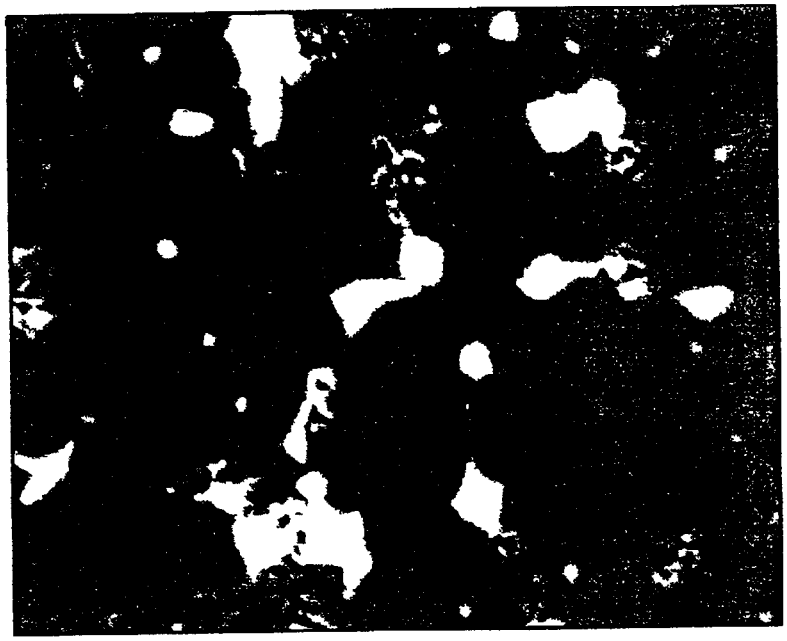
FIG. 5A is a backscattering electron image of Sintered Magnet B ($Nd_{11.8}La_{2.4}Fe_{79.7}B_{6.1}$)
Figure 5B:
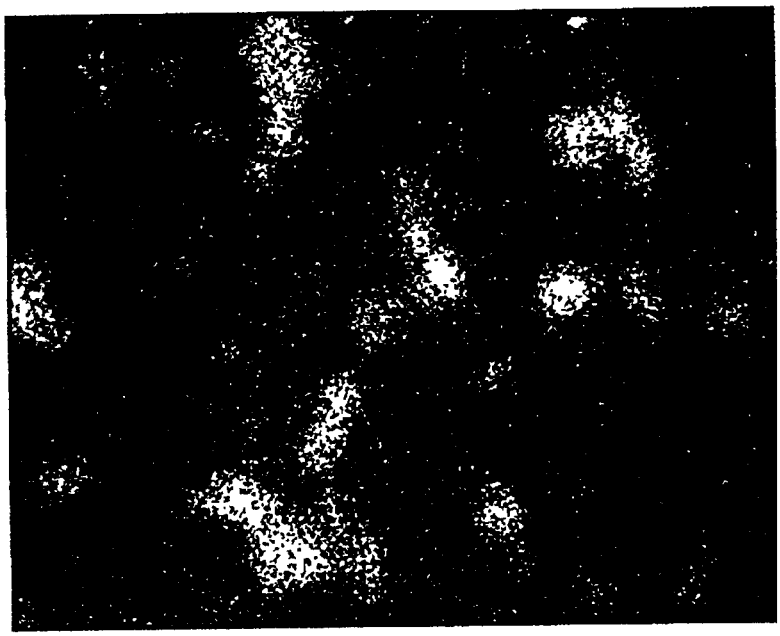
FIG. 5B is an La mapping image of Sintered Magnet B.
Figure 5C:
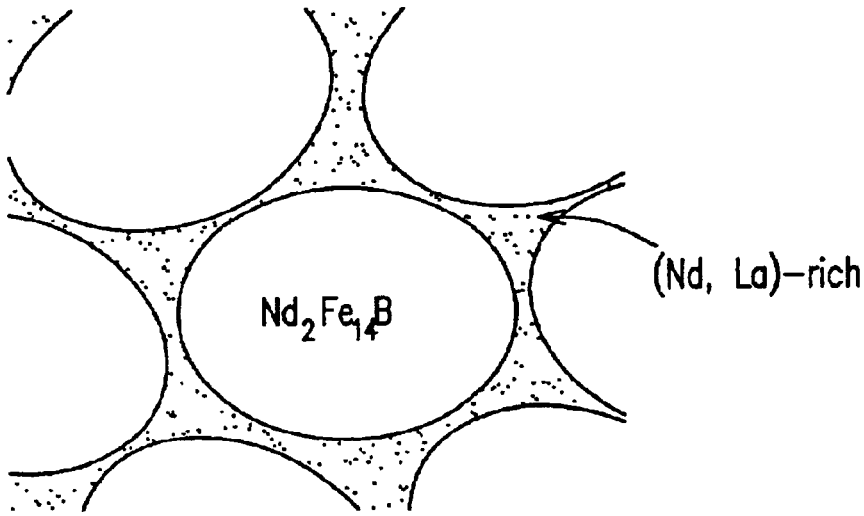
FIG. 5C is a schematic diagram illustrating the microstructure of Sintered Magnet B.
Figure 6A:
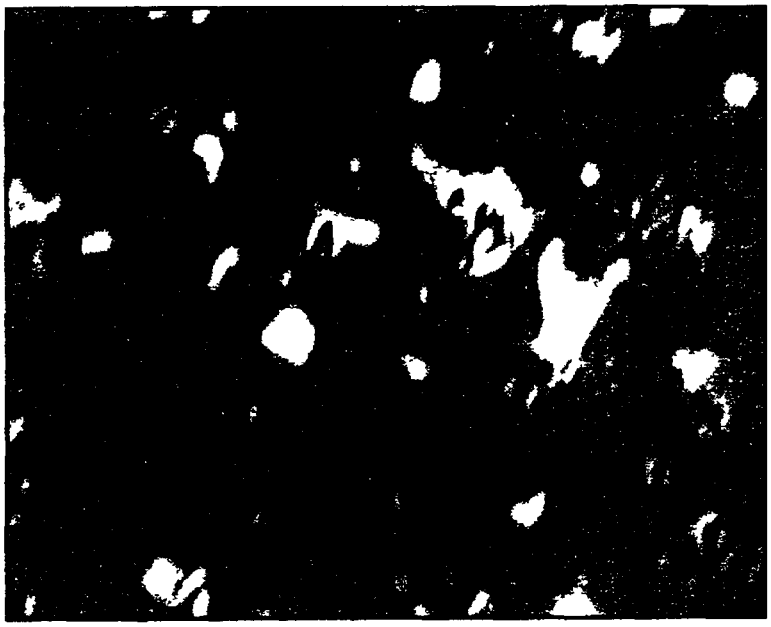
FIG. 6A is a backscattering electron image of Sintered Magnet C ($Nd_{11.8}Ce_{2.4}Fe_{79.7}B_{6.1}$)
Figure 6B:
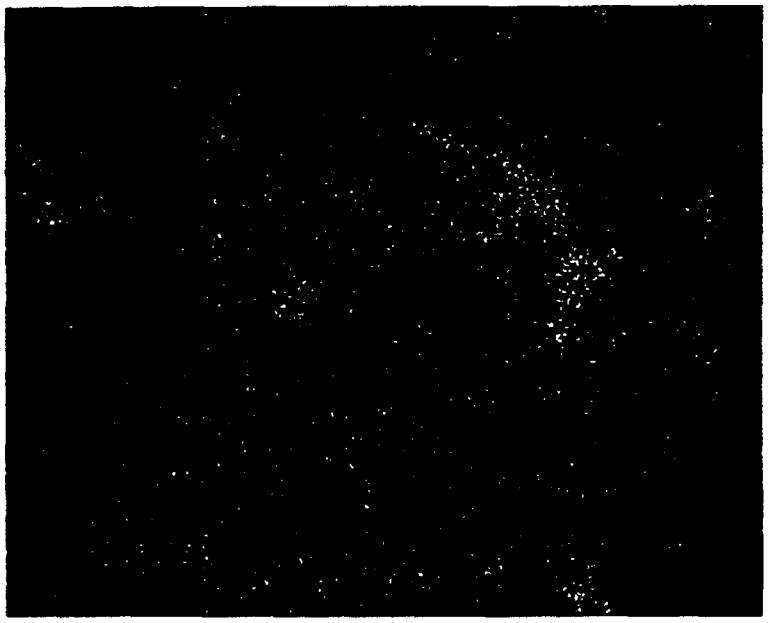
FIG. 6B is a Ce mapping image of Sintered Magnet C.
Figure 6C:
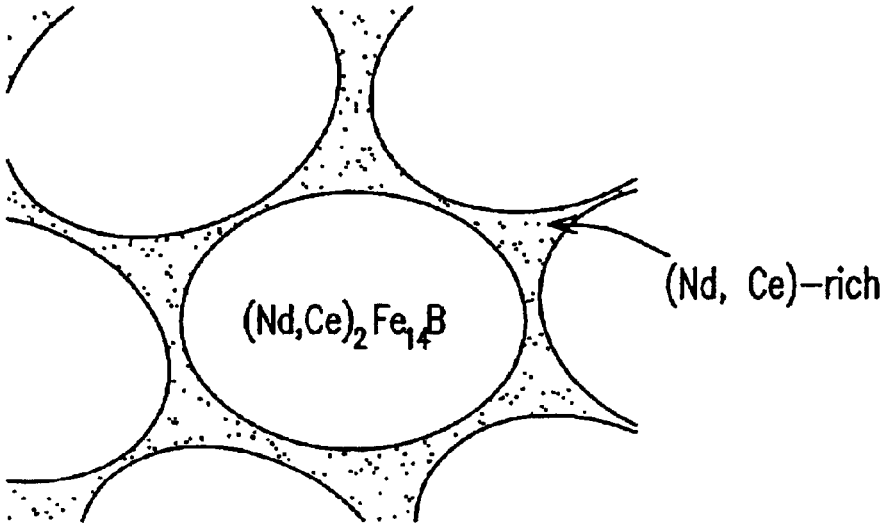
FIG. 6C is a schematic diagram illustrating the microstructure of Sintered Magnet C.

FIG. 4A to FIG. 4C are a backscattering electron image, a fluorescent X-ray image and a schematic diagram, respectively, showing the microstructure of Magnet A, and FIG. 5A to FIG. 5C and FIG. 6A to FIG. 6C are those for Magnets B and C, respectively. In the s shown in FIG. 4A, FIG. 5A and FIG. 6A, a bright area represents a grain boundary phase and a dark area represents a main phase. As shown in the fluorescent X-ray images of FIG. 4B and FIG. 5B, Y and La are present in the grain boundary phase in large and substantially uniform amounts, indicating that Y and La have been segregated from the main phase and concentrated in the grain boundary phase. In contrast, as shown in FIG. 6B, Ce is present substantially uniformly across the sintered magnet, and concentration of Ce in the grain boundary phase was not observed.

According to various experiments conducted by the present inventors, it is preferred that the molar fractions x and y in the composition $(R1_x+R2_y)T_{100-x-y-z}Q_z$ satisfy $0.01 \leqq y/(x+y) \leqq 0.23$.

Embodiment 2

A second embodiment of the present invention will now be described. In the present embodiment, Y, La and/or Sc are added, in addition to Nd and/or Pr, and these elements are concentrated in a grain boundary phase, so that an amount of a transition metal such as Co that would otherwise be consumed for the formation of a ferromagnetic compound in the grain boundary phase is taken into the main phase crystal grains. In this way, Fe in the main phase ($Nd_2Fe_{14}B$ phase) providing hard magnetism is efficiently substituted with Co, etc.

If Co is added in the present invention, a large amount of Co is present in the $Nd_2Fe_{14}B$ phase, which is the main phase. In contrast, if, as in the prior art, Co is added in large amounts without adding Y, La or Sc, a large amount of Co is present also in the grain boundary phase, thereby forming a ferromagnetic compound in the grain boundary phase. As described above, when a large amount of a ferromagnetic compound such as $NdCo_2$ is formed in the grain boundary phase, it not only decreases the amount of Co contributing to the increase in Curie temperature in the main phase, but also decreases the coercive force of the magnet as a whole.

In the present invention, however, Y, La and/or Sc are concentrated in the grain boundary phase, decreasing the Co concentration in the grain boundary phase, whereby $Nd_3Co$ is more likely to be produced than $NdCo_2$. Since $Nd_3Co$ is a non-magnetic compound, it does not decrease the coercive force of the sintered magnet.

Moreover, in the present invention, a large amount of Nd or Pr is efficiently taken into the main phase as a result of Y, La and/or Sc being concentrated in the grain boundary phase, whereby it is possible to reduce the amount of Nd or Pr to be used without substantially decreasing the magnetization.

According to an experiment conducted by the present inventors, Y exists initially in the main phase, thereby decreasing the magnetization, in the stage of a material alloy such as an ingot cast alloy or a quenched alloy (a strip cast alloy). A feature of the present invention lies in that Y in the main phase is concentrated in the grain boundary phase through a sintering process after making a powder of such a material alloy.

Next, a feature of a magnet according to the present embodiment will be described with reference to FIG. 7A to FIG. 7D.

FIG. 7A to FIG. 7D are schematic diagrams of main phase crystal grains and a grain boundary phase, illustrating how Nd, Y and Co are diffused and distributed through a sintering process from the material alloy stage.

Figures 7A, 7B, 7C, 7D:
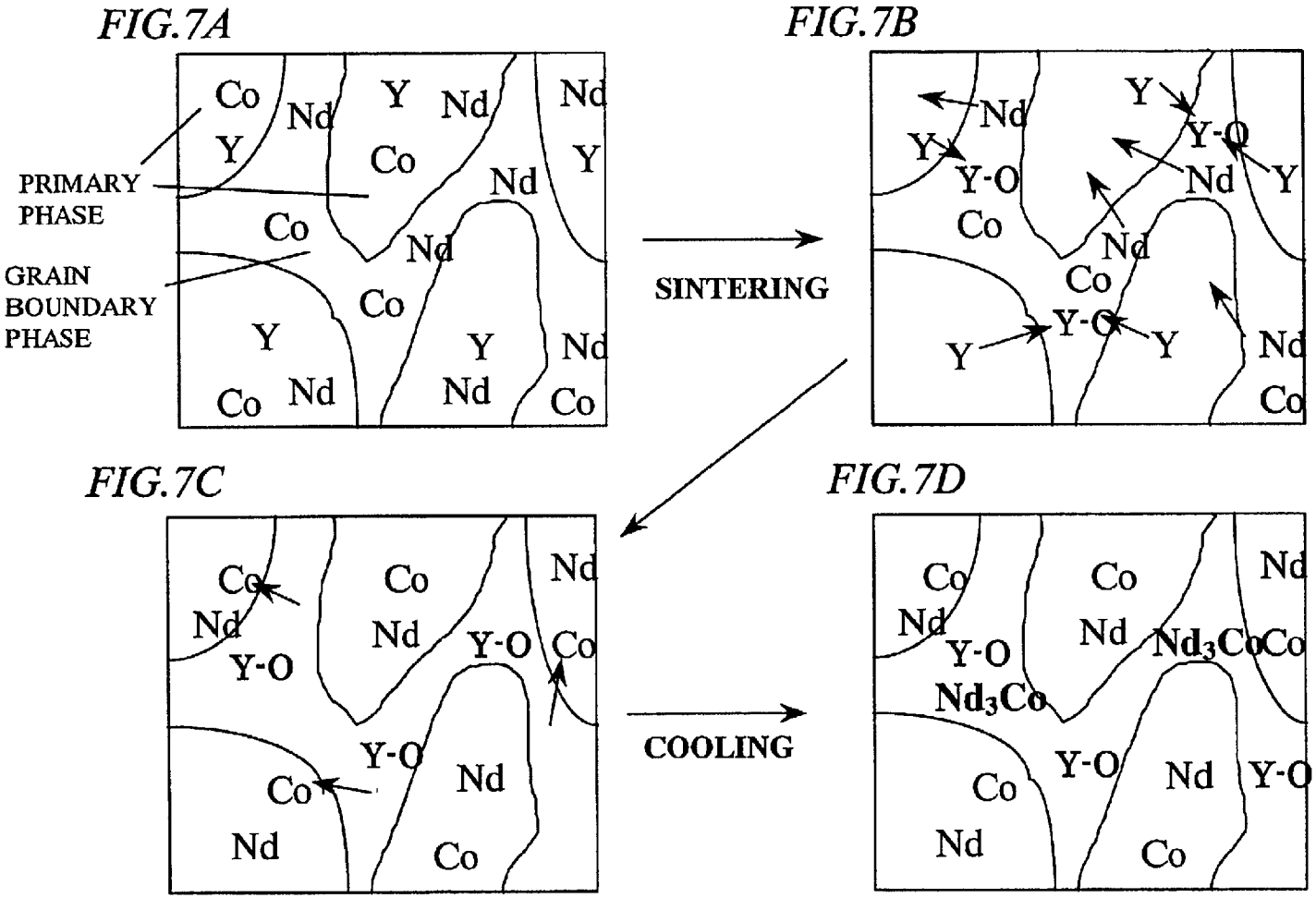

First, as illustrated in FIG. 7A, in the mother alloy stage, Y and Nd are both taken in the main phase crystal grains, forming the $Nd_2Fe_{14}B$ phase, which is the main phase. The Y concentration in the grain boundary phase is lower than that in the grains, and an Nd-rich phase is formed in the grain boundary phase. Co exists in the main phase and in the grain boundary phase.

In a rapidly cooled alloy such as a strip cast alloy, R2 such as Y exists also in the grain boundary phase due to a non-equilibrium state. R2 existing in the grain boundary also has the same effect in subsequent steps as that of Y existing in the main phase.

According to the present invention, Y is diffused from the inside of the crystal grains (main phase) into the grain boundary phase through the sintering process, thereby producing an oxide of Y in the grain boundary phase, as illustrated in FIG. 7B. At this time, Nd is diffused in the opposite direction. As a result, the Y concentration in the grain boundary phase can be increased to be greater than that in the main phase crystal grains, reducing the amount of Y contained in the main phase, as illustrated in FIG. 7C, thereby increasing the magnetization. The grain boundary phase is turned into a Y-rich phase as a result of the mutual diffusion of Y and Nd, whereby Co also moves into the main phase.

It is believed that in order to realize the mutual diffusion of Y and Nd (and Co) as described above, an appropriate amount of oxygen needs to be present in the grain boundary phase during the sintering process. This is because the present invention causes the diffusion, as described above, and relies upon the fact that Y more stably combines with oxygen to form an oxide than Nd. For introduction of oxygen into the grain boundary phase, it is preferred to slightly oxidize the powder particle surface in the pulverization step, for example.

The second embodiment of the present invention will now be described in greater detail.

Material Alloy

First, a rare-earth alloy having a composition of $(R1_x+R2_y)(T1_p+T2_q)_{100-x-y-z-r}Q_zM_r$ is prepared. In the composition, R1 is at least one element selected from the group consisting of all rare-earth elements excluding La (lanthanum), Y (yttrium) and Sc (scandium); R2 is at least one element selected from the group consisting of La, Y and Sc; Ti is Fe; T2 is at least one element selected from the group consisting of all transition elements excluding Fe; Q is at least one element selected from the group consisting of B and C; M is at least one element selected from the group consisting of Al, Ga, Sn and In; and the molar fractions x, y, z, p, q and r satisfy $8 \leqq x+y \leqq 18$ at %, $0<y \leqq 4$ at %, $3 \leqq z \leqq 20$ at %, $0<q \leqq 20$ at %, $0<q/(p+q) \leqq 0.3$ at % and $0 \leqq r \leqq 3$ at %, respectively. Note that $p+q=100-x-y-z-r$ is satisfied.

For example, an ingot casting method or a quenching method (a strip casting method or a centrifugal casting method) may be used for making such an alloy. As an example, a method of making a material alloy by using a strip casting method will now be described.

First, an alloy having a composition as shown above is melted in a high frequency melting process in an argon atmosphere to obtain a molten alloy. After maintaining the molten alloy at 1350° C., the molten alloy is rapidly cooled by a single chill roll method so as to obtain a solidified alloy in the form of flakes having a thickness of about 0.3 mm, for example. The cooling conditions include, for example, a roll circumferential speed of about 1 m/sec, a cooling rate of 500° C./sec and a sub-cooling degree of 200° C. The rapidly cooled alloy thus obtained is pulverized into flakes having a size of 1 to 10 mm before the hydrogen pulverization process. A method of producing a raw material alloy by a strip casting method is disclosed in, for example, U.S. Pat. No. 5,383,978.

As noted above, Y exists in the $Nd_2Fe_{14}B$ main phase in such a material alloy stage.

First Pulverization Step

The material alloy that has been coarsely pulverized into flakes is filled into a plurality of raw material packs (made of stainless steel, for example) and mounted on a rack. Then, the rack with the raw material packs mounted thereon is inserted into a hydrogen furnace. Then, the hydrogen furnace is closed and a hydrogen pulverization process is started. The hydrogen pulverization process is performed in accordance with a temperature profile illustrated in FIG. 2, for example. In the example of FIG. 2, an evacuation process I is performed for 0.5 hour, after which a hydrogen occlusion process II is performed for 2.5 hours. In the hydrogen occlusion process II, a hydrogen gas is supplied into the furnace so as to turn the inside of the furnace into a hydrogen atmosphere. At this time, the hydrogen pressure is preferably about 200 to about 400 kPa.

Then, a dehydrogenation process III is performed for 5.0 hours under a depressurized atmosphere of about 0 to about 3 Pa, after which a material alloy cooling process IV is performed for 5.0 hours while supplying an argon gas into the furnace.

In the cooling process IV, while the atmosphere temperature in the furnace is relatively high (e.g., greater than 100° C.), the material alloy is cooled by supplying an inert gas at normal temperature into the hydrogen furnace. Then, after the material alloy temperature has decreased to a relatively low level (e.g., 100° C. or less), an inert gas that has been cooled below normal temperature (e.g., about 10° C. lower than room temperature) is supplied into the hydrogen furnace. It is preferred, in terms of the cooling efficiency, to cool the material alloy in this way. The amount of the argon gas to be supplied may be set to about 10 to about 100 $Nm^3$/min.

It is preferred that after the temperature of the material alloy has decreased to be about 20 to about 25° C., an inert gas of a generally normal temperature (a temperature that is lower than room temperature by 5° C. or less) is supplied into the hydrogen furnace, allowing the temperature of the material alloy to reach a normal temperature level. In this way, it is possible to avoid dew condensation in the furnace occurring when the hydrogen furnace is opened. When moisture is present in the furnace due to dew condensation, the moisture is frozen/vaporized in the evacuation process, thereby making it difficult to increase the degree of vacuum and increasing the period of time required for the evacuation process I.

It is preferred that the coarsely-pulverized alloy powder obtained through the hydrogen pulverization process is taken out of the hydrogen furnace under an inert atmosphere so that the coarsely pulverized powder does not contact the atmospheric air. In this way, the coarsely pulverized powder is prevented from being oxidized and generating heat, and the magnetic properties of the magnet are improved. Then, the coarsely-pulverized material alloy is filled into a plurality of raw material packs and mounted on a rack.

Through the hydrogen pulverization process, the rare-earth alloy is pulverized to a size of about 0.1 to several millimeters, with the average particle diameter being 500 μm or less. It is preferred that after the hydrogen pulverization process, the embrittled material alloy is milled into finer powder and cooled by using a cooling device such as a rotary cooler. When the material is taken out at a relatively high temperature, the duration of the cooling process using a rotary cooler, or the like, can be increased accordingly.

A large amount of Nd is exposed on the surface of the coarsely pulverized powder which has been made through the hydrogen pulverization process, and the coarsely pulverized powder in this state is very likely to be oxidized.

Second Pulverization Process

Next, the coarsely pulverized powder that has been made in the first pulverization process is finely pulverized by using a jet mill. A cyclone classifier is connected to the jet mill used in the present embodiment.

The jet mill receives a supply of the rare-earth alloy (coarsely pulverized powder) that has been coarsely pulverized in the first pulverization process, and the rare-earth alloy is pulverized in the pulverizer. The powder that has been pulverized in the pulverizer is collected in a collection tank via the cyclone classifier.

The process will now be described in greater detail.

The coarsely pulverized powder is introduced into the pulverizer and is flung up in the pulverizer by a rapid flow of an inert gas injected from an internal nozzle. Thus, the coarsely pulverized powder flies around in the pulverizer along with the rapid gas flow so as to be finely pulverized through collision between powder particles being pulverized.

The finely pulverized powder particles ride an upward gas flow so as to be introduced into a classification rotor. Then, the powder particles are classified by the classification rotor, and coarse powder particles are pulverized again. Those powder particles that have been pulverized to a particle diameter less than or equal to a pre-determined particle diameter are introduced into the classifier main body of the cyclone classifier. In the classifier main body, relatively large powder particles having a particle diameter equal to or greater than the predetermined particle diameter are deposited into the collection tank provided in the bottom, while super fine powder particles are discharged through a discharge pipe along with the inert gas flow.

In the present embodiment, a slight amount of oxygen (20000 ppm or less by volume; e.g., about 10000 ppm) is mixed with the inert gas introduced into the jet mill. In this way, the surface of the finely pulverized powder is oxidized to an appropriate degree so that rapid oxidization/heat generation does not occur when the finely pulverized powder contacts the air atmosphere.

It is believed that oxidization of the powder particle surface plays an important roll in the diffusion of Y from the main phase into the grain boundary phase in the sintering process. According to a study by the present inventors, it is preferred that the amount of oxygen in the powder is adjusted to be in the range of 2000 to 8000 ppm (by weight).

Moreover, in order to diffuse Y from the inside of the particles into the grain boundary phase, it is preferred that the average particle diameter (FSSS particle size) of the powder is 5 μm or less, more preferably, 4 μm or less. When the particle diameter is greater than 5 μm, Y needs to diffuse over an excessive distance, thereby increasing the amount of Y remaining in the crystal grains (main phase), and thus decreasing the magnetization.

Press-Compaction

In the present embodiment, a lubricant in an amount of 0.3 wt %, for example, is added and mixed in the magnetic powder obtained as described above in a rocking mixer so as to cover the surface of the alloy powder particles with the lubricant. The lubricant may be a lubricant obtained by diluting a fatty acid ester with a petroleum solvent. In the present embodiment, methyl caproate is used as a fatty acid ester and isoparaffin as a petroleum solvent. The weight ratio between methyl caproate and isoparaffin is, for example, 1:9. Such a liquid lubricant covers the surface of the powder particles, thereby preventing the particles from being oxidized while improving the orientation property during a pressing process and facilitating the removal of the compact following a pressing process (by making the density of the compact uniform so as to prevent the compact from being broken apart or cracked).

The type of lubricant is not limited to the above. Instead of methyl caproate, the fatty acid ester may be, for example, methyl caprylate, methyl laurylate, methyl laurate, or the like. The solvent may be a petroleum solvent such as isoparaffin, a naphthenic solvent, or the like. The lubricant may be added at any timing, i.e., before the fine pulverization by the jet mill, during the fine pulverization or after the fine pulverization. A solid dry lubricant such as zinc stearate may be used instead of, or in addition to, a liquid lubricant.

The magnetic powder obtained as described above is then compacted in an orientation magnetic field by using a known compacting apparatus.

Sintering Process

A step of maintaining the powder compact at a temperature in the range of 650 to 1000° C. for 10 to 24 minutes, and a step of further sintering the powder compact at a higher temperature (e.g., 1000 to 1100° C.), are performed successively. During the sintering process, particularly, during a period in which a liquid phase is produced (while the temperature is in the range of 650 to 1000° C.), Nd starts to be melted, and mutual diffusion occurs between Y, existing primarily in the main phase crystal grains, and Nd, existing primarily in the grain boundary phase. Specifically, Y diffuses from the main phase into the grain boundary phase under a diffusion-driving force that is in proportion to the concentration gradient between the inside of the main phase crystal grains and the grain boundary phase (corresponding to "the difference between the Y concentration in the main phase and that in the liquid phase"), whereas Nd diffuses in the opposite direction, i.e., from the grain boundary phase into the main phase.

According to this embodiment, a sintered magnet in which the amount of oxygen is in the range from 2000 to 8000 ppm by weight. The amount of hydrogen in the sintered magnet is in the range from 5 to 100 ppm by weight, since the amount of residual hydrogen in the powder particle decreases during the heat treatment at a temperature of 650 to 1000° C.

Since Y having diffused into the grain boundary phase combines with oxygen existing in the grain boundary phase so as to be turned into an oxide and consumed, the Y concentration gradient to be the diffusion-driving force is maintained. Since Y more stably forms an oxide than Nd, Y diffuses from the main phase into the liquid phase while Nd diffuses from the liquid phase into the main phase. At this time, the grain boundary phase is turned into a Y-rich phase, whereby Co moves into the main phase, partially substituting Fe in the main phase, because of the volume ratio.

In order to sufficiently diffuse Y into the grain boundary phase so that a large amount of Nd, Co, etc., existing in the grain boundary phase is taken into the main phase, it is preferred that the amount of oxygen in the powder is controlled in the range of 2000 to 8000 ppm (by weight) as described above. When the amount of oxygen is less than 2000 ppm by weight, Y is not sufficiently diffused into the grain boundary phase, leaving a large amount of Y in the main phase, thereby decreasing the magnetization. When the amount of oxygen is greater than 8000 ppm by weight, rare-earth elements are consumed by oxide formation, thereby reducing the amount of rare-earth element that contributes to the liquid phase formation. In such a case, the sinter density may decrease, or the magnetic properties may deteriorate due to a decrease in the main phase proportion.

Also in a case where La and/or Sc are added, it is possible, by concentrating these elements in the grain boundary phase, to suppress the consumption, in the grain boundary phase, of a transition metal element, such as Co, and a rare-earth element that is indispensable for the main phase, such as Nd or Pr.

Description of Each Element in Alloy Composition

The rare-earth element R1 may specifically be at least one element selected from the group consisting of praseodymium (Pr), neodymium (Nd), samarium (Sm), gadolinium (Gd), terbium (Tb), dysprosium (Dy), holmium (Ho), erbium (Er), thulium (TM), and lutetium (Lu). In order to obtain a sufficient degree of magnetization, it is preferred that 50 at % or more of the rare-earth element R1 is made up of either one or both of Pr and Nd.

When the total amount of rare-earth element (R1+R2) is less than 8 at %, the coercive force may decrease due to precipitation of an α-Fe phase. When the total amount of rare-earth element (R1+R2) is greater than 18 at %, a large amount of an R-rich second phase may precipitate in addition to the intended tetragonal $Nd_2Fe_{14}B$ compound, thereby decreasing the magnetization. Thus, the total amount of rare-earth element (R1+R2) is preferably in the range of 8 to 18 at % of the total amount.

Transition metal elements other than Co, such as Ni, V, Cr, Mn, Cu, Zr, Nb and Mo may suitably be used as T2. It is preferred that the amount of T1 (i.e., Fe), one of the two transition metal elements T1 and T2, is 50 at % or more. When the amount of Fe is less than 50 at %, the saturation magnetization of the $Nd_2Fe_{14}B$ compound itself decreases. In the present invention, R2 is localized in the grain boundary phase, whereby T2 added is efficiently taken into the main phase. Since R2 no longer forms a large amount of undesirable compounds in the grain boundary phase, the R2 content can be increased from that in the prior art. In the present invention, the T2 content can be increased up to 20 at %.

Q is B and/or C, and is indispensable for stable precipitation of the tetragonal $Nd_2Fe_{14}B$ crystalline structure. When the Q content is less than 3 at %, an $R_2T_{17}$ phase precipitates, thereby decreasing the coercive force and significantly deteriorating the squareness of a demagnetization curve. When the Q content is greater than 20 at %, a second phase with a low degree of magnetization precipitates. Therefore, the Q content is preferably in the range of 3 to 20 at %.

In order to further increase the magnetic anisotropy of a powder, an additional element M may be used. The additional element M may suitably be at least one element selected from the group consisting of Al, Ga, Sn, and In. Alternatively, the additional element M may not be added at all. If added, it is preferred that the amount of the additional element M to be added is 3 at % or less. When the amount of the additional element M to be added is greater than 3 at %, a second phase, instead of a ferromagnetic phase, precipitates, thereby decreasing the magnetization. While the additional element M is not necessary for the purpose of obtaining a magnetic powder that is magnetically isotropic, Al, Cu, Ga, etc., may be added for the purpose of increasing the intrinsic coercive force.

EXAMPLE

An example of the second embodiment of the present invention will now be described.

In this example, various material alloy compositions represented by $(R1_x+R2_y)(T1_p+T2_q)_{100-x-y-z-r}Q_zM_r$ were prepared, where R1 is Nd and Dy, R2 is Y (Yttrium), T1 is Fe, T2 is Co, Q is B (boron), and M is Cu and Al. Each composition was adjusted so as to contain 5 to 10 at % of Nd, 4 at % of Dy, 0 to 5 at % of Y, 0 to 6 at % of Co, 6 at % of B, 0.2 at % of Cu, and 0.4 at % of Al, with the balance being the amount of Fe.

Each alloy composition was heated to about 1400° C. in an Ar atmosphere to obtain a molten alloy, and the molten alloy was poured into a water-cooled mold. The molten alloy was cooled to obtain a solidified alloy having a thickness of about 5 mm.

After the solidified alloy was allowed to occlude hydrogen, it was heated to about 600° C. while evacuating the atmosphere so as to be embrittled (hydrogen pulverization process). A coarsely pulverized powder was obtained from the alloy composition through the hydrogen pulverization process. The coarsely pulverized powder was finely pulverized by a jet mill, thereby making a powder whose average particle diameter (FSSS particle size) is about 3.5 μm. A nitrogen gas containing about 10000 ppm (by volume) of oxygen was used as the pulverization atmosphere in the jet mill.

Each powder thus obtained was pressed at 100 MPa (megapascal) to obtain a compact having a size of 55 mm×25 mm×20 mm. During the pressing process, an orientation magnetic field was applied in the direction perpendicular to the pressing direction so as to orient the powder.

Then, the powder was sintered in an Ar atmosphere. The sintering temperature was 1060° C. and the sintering time was about 4 hours.

Each sintered magnet thus obtained was evaluated for the Curie point and the coercive force.

Figure 8:
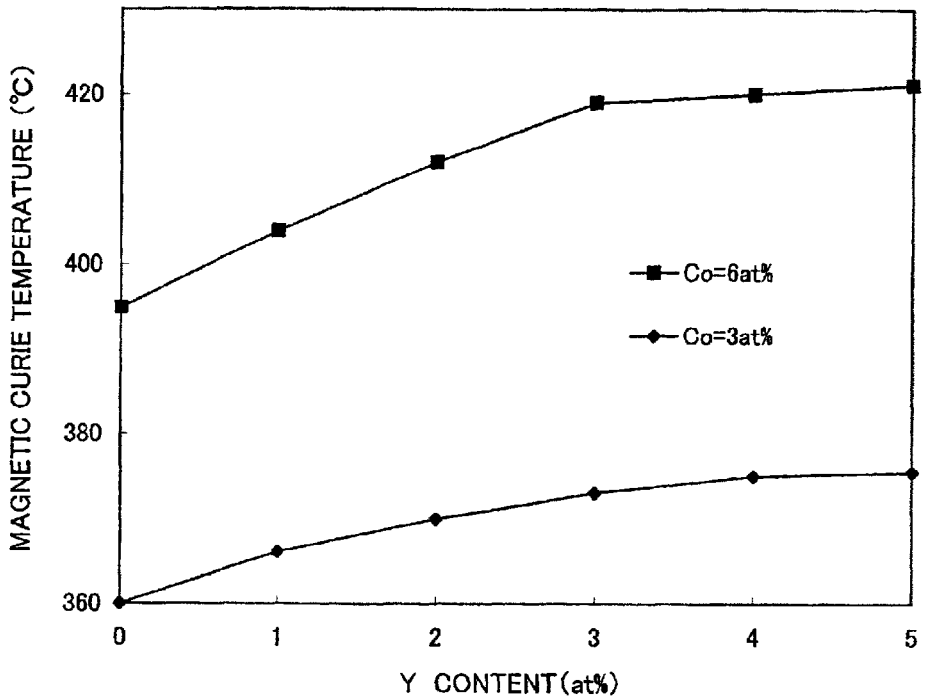
FIG. 8 is a graph illustrating the relationship among the Curie point (Curie temperature), the Y content and the Co content, with the vertical axis of the graph representing the Curie temperature and the horizontal axis representing the Y content.
Figure 9:
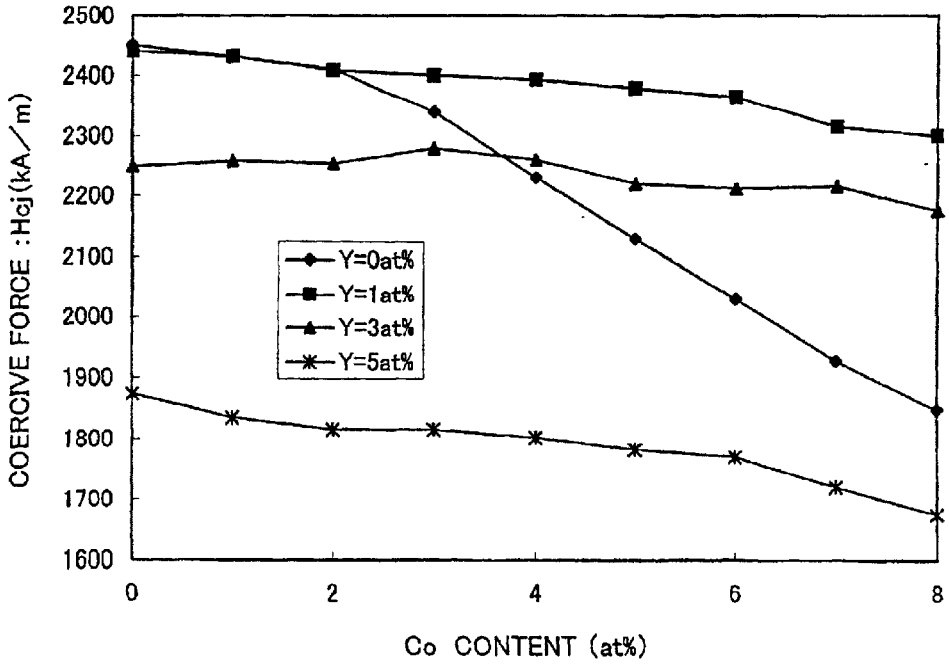
FIG. 9 is a graph illustrating the relationship among the coercive force $H_{cj}$, the Y content and the Co content, with the vertical axis of the graph representing the coercive force and the horizontal axis representing the Co content.

FIG. 8 is a graph illustrating the relationship between the Curie temperature (Curie point) and the Y content for Co contents of 3 at % and 6 at %. FIG. 9 is a graph illustrating the relationship between the coercive force $H_{cj}$ and the Co content for Y contents of 0 at %, 1 at %, 3 at % and 5 at %.

First, as can be seen from FIG. 8, while the Curie temperature increases as the Y content is increased from 0 at %, it is substantially saturated at a certain level. The saturation level is higher as the Co content is higher. It can be confirmed from FIG. 8 that the Curie temperature increasing effect of Co is improved by adding Y.

On the other hand, FIG. 9 indicates the following.

When no Y is added, the coercive force rapidly decreases as the Co content increases. In contrast, when an appropriate amount of Y is added, the Co content can be increased without decreasing the coercive force. In other words, adding Y makes it possible to increase the Co content to sufficiently improve the Curie temperature while avoiding a substantial decrease in the coercive force.

Referring to FIG. 9, when no Y is added, the coercive force decreases substantially when the Co content exceeds about 2 at %. It is believed that this is because the amount of $NdCo_2$ (a ferromagnetic compound) to be formed in the grain boundary phase increases as the Co content is increased, if no Y is added.

For low Co contents, no substantial difference is observed between the coercive force in a case where no Y is added and that in a case where the Y content is 1 at %. However, for Co contents of about 3 at % or more, the coercive force with no addition of Y substantially decreases as the Co content increases, whereas the coercive force with addition of Y is kept at a substantially constant level irrespective of the Co content. This is because the amount of $NdCo_2$ (a ferromagnetic compound) to be formed in the grain boundary phase is suppressed to a low level as an effect of the addition of Y. However, when the Y content is excessive (e.g., 5 at % or more), the amount of Y oxide in the grain boundary phase increases and the coercive force decreases. According to an experiment conducted by the present inventors, the Y content range is preferably $0<y\leqq 4$ at %, and more preferably $0.5<y\leqq 3$ at %. If it is desired to avoid a decrease in the coercive force as much as possible, the upper limit of the Y content may be further lowered to about 2 at %.

With the Y content being optimized, it is possible to increase the Co content up to 20 at %. In the present invention, the Co content range is preferably $0<q\leqq 20$ at %, and more preferably $0<q\leqq 15$ at %.

Next, the microstructures of an ingot alloy and a sintered magnet each having a composition of $Nd_{10}Dy_4Y_2Fe_{71}Co_7B_6$ were observed by using an EPMA (electron probe microanalyzer).

FIG. 10A to FIG. 10F are a backscattering electron image and fluorescent X-ray images of the ingot alloy, and FIG. 11A to FIG. 11F are a backscattering electron image and fluorescent X-ray images of the sintered magnet.

Figure 10A:
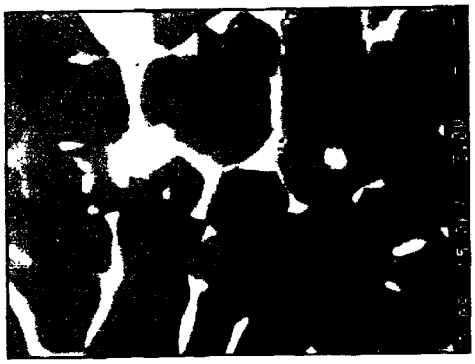
FIG. 10A is a backscattering electron image of a material alloy.
Figure 11A:
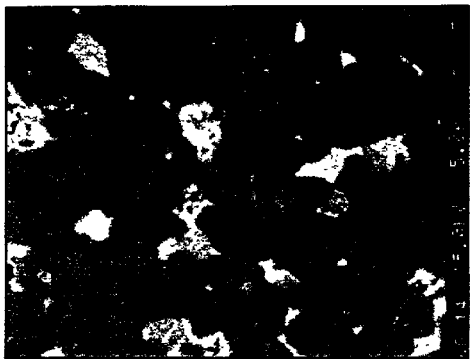
FIG. 11A is a backscattering electron image of a sintered magnet.
Figure 11B:
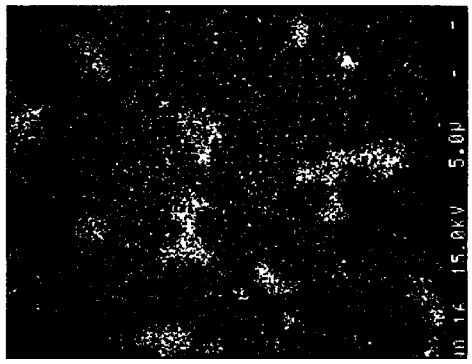
FIG. 11B to FIG. 11F are mapping images of the sintered magnet for Nd, Dy, Co, Fe and Y, respectively.
Figure 11C:
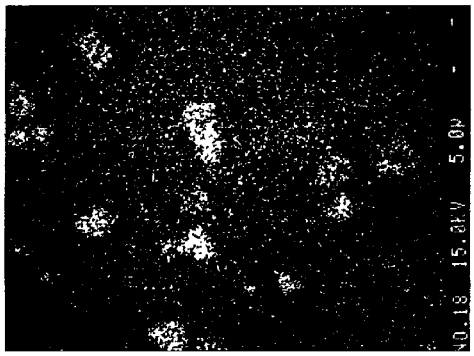

In the backscattering electron images shown in FIG. 10A and FIG. 11A, a bright area represents a grain boundary phase and a dark area represents a main phase crystal grain.

FIG. 10B to FIG. 10F and FIG. 11B to FIG. 11F are fluorescent X-ray images for Nd, Dy, Co, Fe and Y, respectively.

Figure 10B:
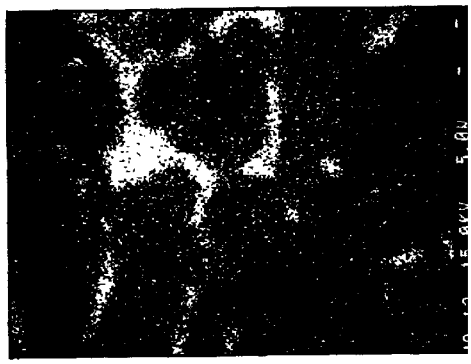
FIG. 10B to FIG. 10F are mapping images of the material alloy for Nd, Dy, Co, Fe and Y, respectively.
Figure 10C:
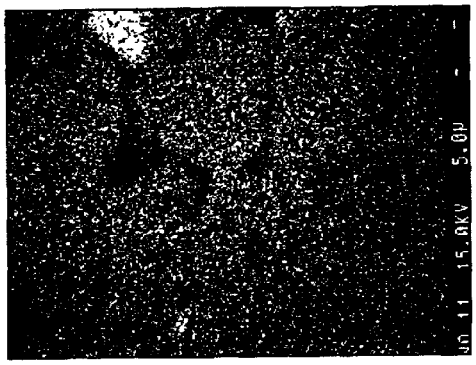
Figure 10D:
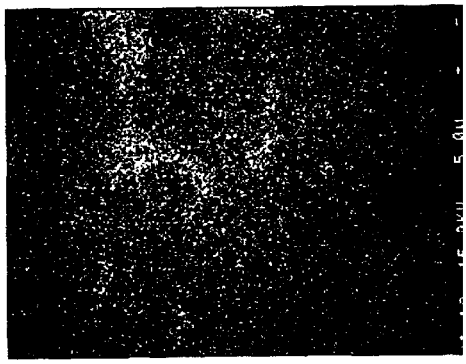
Figure 10E:
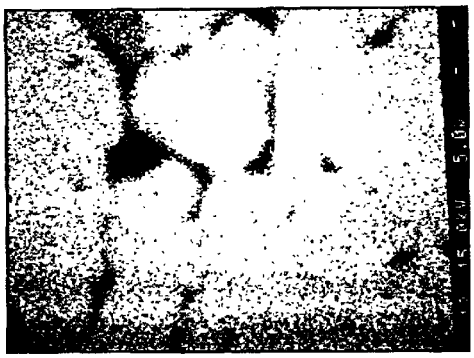
Figure 10F:
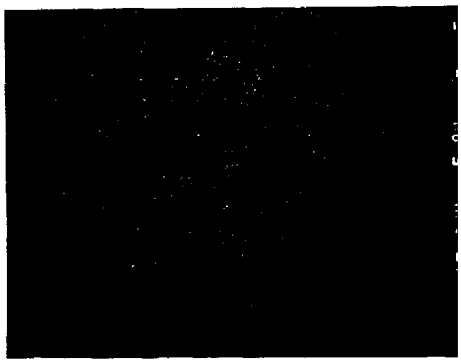

As can be seen from a comparison between FIG. 10A and FIG. 10B, a large amount of Nd exists in the grain boundary phase in the ingot alloy stage. As can be seen from a comparison between FIG. 10A and FIG. 10D, a large amount of Co also exists in the grain boundary phase in this stage. In contrast, as can be seen from a comparison between FIG. 10A and FIG. 10F, a large amount of Y exists in the main phase.

Figure 11D:
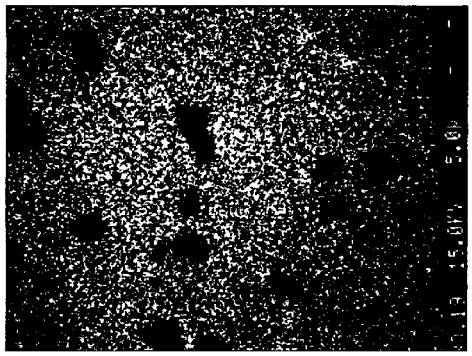
Figure 11E:
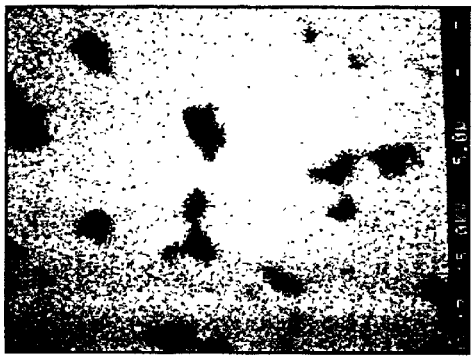
Figure 11F:
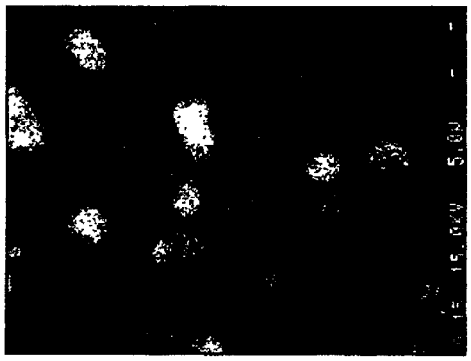

In the sintered magnet stage, a large amount of Y exists (concentrated) in the grain boundary phase as can be seen from FIG. 11F, and a large amount of Co is taken into the main phase as can be seen from a comparison between FIG. 11A and FIG. 11D.

Thus, it can been seen that Co moves from the grain boundary phase into the main phase as a result of Y being concentrated in the grain boundary phase through a sintering process. In the main phase, Fe is substituted with Co, thereby contributing to an increase in the Curie temperature. In a case where a large amount of Co exists in the grain boundary phase as in the prior art, a large amount of $NdCo_2$, a ferromagnetic substance, is formed after the sintering process. In contrast, in the present invention, the Co concentration in the grain boundary phase substantially decreases due to the action of Y, whereby substantially no $NdCo_2$, which is a ferromagnetic substance, is formed in the grain boundary phase, and the decrease in the coercive force is suppressed.

It is preferred that the molar fractions x and y in the composition $(R1_x+R2_y)\ (T1_p+T^2_q)_{100-x-y-z-r}Q_zM_r$ satisfy $0.01\leqq y/(x+y)\leqq 0.23$.

An R—Fe—B magnet has a problem in that it has poor corrosion resistance because the rare-earth element R is easily oxidized, thereby deteriorating the magnetic properties. It is believed that an R—Fe—B magnet has a poor corrosion resistance for the following reason. Nd and/or Pr existing in the grain boundary in the R—Fe—B magnet react with moisture in the atmospheric air to form a hydroxide. The hydroxide formation causes volume expansion in the grain boundary and thus locally generates a strong stress, thereby causing grain detachment in some parts of the magnet. Oxidization and/or corrosion are likely to occur from a site where such grain detachment has occurred.

The present inventors evaluated the corrosion resistance of the rare-earth sintered magnet of the present invention. The compositions (at %) of samples used in the corrosion resistance evaluation are as shown in Table 1 below.

TABLE 1

| | Nd | Y | B | Fe | Al | Cu |
|---|---|---|---|---|---|---|
| Sample 1 | 14.32 | 0 | 1.0 | balance | 0.2 | 0.1 |
| Sample 2 | 13.72 | 0.74 | 1.0 | balance | 0.2 | 0.1 |
| Sample 3 | 12.80 | 1.57 | 1.0 | balance | 0.2 | 0.1 |
| Sample 4 | 11.46 | 2.96 | 1.0 | balance | 0.2 | 0.1 |

Magnet samples 1 to 4 were subjected to a corrosion resistance test in Which the samples were held for 24 hours under an accelerating test environment at 2 atm, 125° C. and a relative humidity of 85%. The degree of corrosion resistance was evaluated in terms of the amount of grain detachment occurring due to corrosion.

As a result of the test, there was no significant difference between Sample 1 and Sample 2. However, Sample 3 had an amount of grain detachment about ½ of that of Sample 1, and Sample 4 had an amount of grain detachment about 1/5 of that of Sample 1.

Y added to the samples strongly combines with oxygen and is stably present as an oxide without forming a hydroxide. Therefore, it is believed that if Y is present in the grain boundary, volume expansion due to the hydroxide formation is less likely to occur and thus grain detachment is also less likely to occur. This is a special effect obtained by the addition of Y, and cannot be obtained by adding La instead of Y.

According to the present invention, Y, or the like, is diffused into the grain boundary phase, whereby it is possible to efficiently utilize a rare-earth element, such as Nd or Pr, that is indispensable for the main phase without wasting such an element in the grain boundary phase, thereby maintaining the magnetization of the main phase at a high level and thus providing a rare-earth sintered magnet that exhibits desirable magnetic properties.

Moreover, according to the present invention, a rare-earth element R2 such as Y is localized in the grain boundary phase, whereby an element (such as Co or Ni) that contributes to improving the magnetic properties in the main phase can be efficiently taken into the main phase without wasting such an element in the grain boundary phase. Furthermore, a rare-earth element that is indispensable for the main phase, such as Nd or Pr, can also be taken into the main phase. Therefore, it is possible to further improve the magnetic properties such as heat resistance while realizing efficient use of these elements.

While the present invention has been described in a preferred embodiment, it will be apparent to those skilled in the art that the disclosed invention may be modified in numerous ways and may assume many embodiments other than that specifically set out and described above. Accordingly, it is intended by the appended claims to cover all modifications of the invention which fall within the true spirit and scope of the invention.

What is claimed is:

1. A rare-earth sintered magnet of a composition of $(R1_x+R2_y)T_{100-x-y-z}Q_z$, where R1 is at least one element selected from the group consisting of all rare-earth elements excluding La, Y and Sc, R2 is Y and may optionally include La and/or Sc, T is at least one element selected from the group consisting of all transition elements, and Q is B and may optionally include C, and comprising a crystal grain of an $Nd_2Fe_{14}B$ type compound as a main phase, wherein:

molar fractions x, y and z satisfy $8 \leqq x \leqq 18$ at %, $0.1 \leqq y \leqq 3.5$ at % and $3 \leqq z \leqq 20$ at %, respectively; and a concentration of R2 is higher in at least a part of a grain boundary phase than in the crystal grain, and wherein an amount of oxygen is in a range of 2000 ppm to 8000 ppm by weight.

2. The rare-earth sintered magnet according to claim 1, wherein the molar fractions x and y satisfy $0.01 \leqq y/(x+y) \leqq 0.23$.

3. A method of producing a rare-earth sintered magnet, comprising the steps of:

preparing a powder of a rare-earth alloy having a composition of $(R1_x+R2_y)T_{100-x-y-z}Q_z$ where R1 is at least one element selected from the group consisting of all rare-earth elements excluding La, Y and Sc; R2 is Y and may optionally include La and/or Sc; T is at least one element selected from the group consisting of all transition elements; and Q is B and may optionally include C, wherein molar fractions x, y and z satisfy $8 \leqq x \leqq 18$ at %, $0.1 \leqq y \leqq 3.5$ at % and $3 \leqq z \leqq 20$ at %, respectively, and wherein an amount of oxygen included in the rare-earth alloy powder is in a range of 2000 ppm by weight to 8000 ppm by weight; and sintering the rare-earth alloy powder, wherein R2 existing in a main phase crystal grain of an $Nd_2Fe_{14}B$ crystalline structure in the rare-earth alloy before sintering is diffused into a grain boundary phase in the sintering step, whereby a concentration of R2 is higher in at least a part of the grain boundary phase than in the crystal grain.

4. The method of producing a rare-earth sintered magnet according to claim 3, wherein R1 existing in the grain boundary phase in the rare-earth alloy before sintering is diffused into the main phase crystal grain during the sintering step.

5. The method of producing a rare-earth sintered magnet according to claim 3, wherein an oxide of R2 is formed in the grain boundary phase during the sintering step.

6. The method of producing a rare-earth sintered magnet according to claim 3, wherein the sintering step comprises a first step of maintaining the rare-earth alloy powder at a temperature in a range of 650 to 1000° C. for 10 to 240 minutes, and a second step of further sintering the rare-earth alloy powder at a temperature higher than that used in the first step.

7. The method of producing a rare-earth sintered magnet according to claim 3, wherein the rare-earth alloy powder is obtained through pulverization in a gas whose oxygen concentration is controlled.

8. The method of producing a rare-earth sintered magnet according to claim 3, wherein the rare-earth alloy powder is obtained through pulverization in a gas whose oxygen concentration is controlled to be 20000 ppm or less.

9. The method of producing a rare-earth sintered magnet according to claim 3, wherein an average particle diameter (FSSS particle size) of the rare-earth alloy powder is 5 μm or less.

10. A rare-earth sintered magnet, having a composition of $(R1_x+R2_y)(T1_p+T2_q)_{100-x-y-z-r}Q_zM_r$ where R1 is at least one element selected from the group consisting of all rare-earth elements excluding La, Y and Sc, R2 is Y and may optionally include La and/or Sc: T1 is Fe, T2 is at least one element selected from the group consisting of all transition elements excluding Fe, Q is B and may optionally include C, and M is at least one element selected from the group consisting of Al, Ga, Sn and In, and comprising a crystal grain of an $Nd_2Fe_{14}B$ type compound as a main phase, wherein:

molar fractions x, y, z, p, q and r satisfy $8 \leqq x+y \leqq 18$ at %, $0<y \leqq 4$ at %, $3 \leqq z \leqq 20$ at %, $0<q \leqq 20$ at %, $0<q/(p+q) \leqq 0.3$ at % and $0 \leqq r \leqq 3$ at %, respectively; and wherein an amount of oxygen is in a range of 2000 ppm to 8000 ppm by weight and a concentration of R2 is higher in at least a part of a grain boundary phase than in the crystal grain.

11. The rare-earth sintered magnet according to claim 10, wherein the molar fraction y satisfies $0.5<y \leqq 3$ at %.

12. The rare-earth sintered magnet according to claim 10, wherein T2 includes at least Co.

13. A method of producing a rare-earth sintered magnet, comprising the steps of:

preparing a powder of a rare-earth alloy having a composition of $(R1_x+R2_y)(T1_p+T2_q)_{100-x-y-z-r}Q_zM_r$ where R1 is at least one element selected from the group consisting of all rare-earth elements excluding La), Y and Sc, R2 is Y and may optionally include La and/or Sc: T1 is Fe, T2 is at least one element selected from the group consisting of all transition elements excluding Fe, Q is B and may optionally include C, and M is at least one element selected from the group consisting of Al, Ga, Sn and In), and comprising, as a main phase, a crystal grain of an $Nd_2Fe_{14}B$ crystalline structure, wherein:

molar fractions x, y, z, p, q and r satisfy $8 \leqq x+y \leqq 18$ at %, $0<y \leqq 4$ at %, $3 \leqq z \leqq 20$ at %, $0<q \leqq 20$ at %, $0<q/(p+q) \leqq 0.3$ at % and $0 \leqq r \leqq 3$ at %, respectively, and wherein an amount of oxygen included in the rare-earth alloy powder is in a range of 2000 ppm by weight to 8000 ppm by weight; and sintering the rare-earth alloy powder, wherein R2 existing in the main phase crystal grain of the $Nd_2Fe_{14}B$ crystalline structure in the rare-earth alloy before sintering is diffused into a grain boundary phase in the sintering step, whereby a concentration of R2 is higher in at least a part of the grain boundary phase than in the crystal grain.

14. The method of producing a rare-earth sintered magnet according to claim 13, wherein R1 existing in the grain boundary phase in the rare-earth alloy before sintering is diffused into the main phase crystal grain during the sintering step.

15. The method of producing a rare-earth sintered magnet according to claim 13, wherein an oxide of R2 is formed in the grain boundary phase in the sintering step.

16. The method of producing a rare-earth sintered magnet according to claim 13, wherein the sintering step comprises a first step of maintaining the rare-earth alloy powder at a temperature in a range of 650 to 1000° C. for 10 to 240 minutes, and a second step of further sintering the rare-earth alloy powder at a temperature higher than that used in the first step.

17. The method of producing a rare-earth sintered magnet according to claim 13, wherein the rare-earth alloy powder is obtained through pulverization in a gas whose oxygen concentration is controlled.

18. The method of producing a rare-earth sintered magnet according to claim 13, wherein the rare-earth alloy powder is obtained through pulverization in a gas whose oxygen concentration is controlled to be 20000 ppm or less.

19. The method of producing a rare-earth sintered magnet according to claim 13, wherein an average particle diameter (FSSS particle size) of the rare-earth alloy powder is 5 μm or less.

* * * * *